US009221024B2

(12) United States Patent
Terentiev

(10) Patent No.: US 9,221,024 B2
(45) **Date of Patent: *Dec. 29, 2015**

(54) MIXING BAG OR VESSEL WITH A FLUID-AGITATING ELEMENT

(75) Inventor: Alexandre N. Terentiev, Lexington, KY (US)

(73) Assignee: PALL TECHNOLOGY UK LIMITED, Portsmouth, Hampshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/476,200

(22) Filed: May 21, 2012

(65) Prior Publication Data

US 2012/0281494 A1 Nov. 8, 2012

Related U.S. Application Data

(60) Continuation of application No. 11/829,194, filed on Jul. 27, 2007, now Pat. No. 8,182,137, which is a continuation-in-part of application No. 11/113,677, filed on Apr. 25, 2005, now Pat. No. 7,267,479, which is a continuation of application No. 10/863,910, filed on Jun. 9, 2004, now Pat. No. 6,899,454, which is a division of application No. 09/724,815, filed on Nov.

(Continued)

(51) Int. Cl.

| | |
|---|---|
| ***B01F 15/00*** | (2006.01) |
| ***B65D 67/00*** | (2006.01) |
| ***B65D 85/804*** | (2006.01) |
| ***B65D 88/16*** | (2006.01) |
| ***B01F 7/16*** | (2006.01) |
| ***B01F 13/08*** | (2006.01) |

(52) U.S. Cl.

CPC ..... *B01F 15/00824* (2013.01); *B01F 7/162* (2013.01); *B01F 7/1695* (2013.01); *B01F 13/0818* (2013.01); *B01F 13/0827* (2013.01); *B01F 15/0085* (2013.01)

(58) Field of Classification Search

CPC ..... B01F 15/0085; B01F 2215/0037; B01F 13/08; B01F 15/00824; B01F 7/162; B01F 7/1695; B65D 88/1612; B65D 85/804

USPC ..... 366/273, 274; 220/495.06, 495.07, 220/495.08, 495.09, 495.1, 495.11; 206/548, 549, 547

See application file for complete search history.

(56) References Cited

U.S. PATENT DOCUMENTS

| | | | | | |
|---|---|---|---|---|---|
| 3,647,397 | A | * | 3/1972 | Coleman | 366/273 |
| 3,704,777 | A | * | 12/1972 | Linnebuhr | 206/338 |
| 3,868,016 | A | * | 2/1975 | Szpur et al. | 206/350 |
| 4,150,746 | A | * | 4/1979 | Buglione | 206/372 |
| 4,214,874 | A | * | 7/1980 | White | 366/273 |
| 4,830,511 | A | * | 5/1989 | Smazik | 366/273 |
| 5,356,373 | A | * | 10/1994 | Dracker | 604/4.01 |
| 5,533,804 | A | * | 7/1996 | Larsson et al. | 366/274 |

(Continued)

*Primary Examiner* — Tony G Soohoo

(74) *Attorney, Agent, or Firm* — King & Schickli, PLLC

(57) ABSTRACT

A vessel receives and agitates a fluid using an internal fluid-agitating element driven by an external motive device. In one aspect, the vessel is a bag including a first receiver for receiving and holding a fluid-agitating element at a home location. The first receiver may be in the form of an inwardly-projecting post having an oversized portion for capturing the fluid-agitating element, but various other forms are disclosed. Use of this feature in completely rigid vessels where the fluid-agitating element is free of direct attachment from a first receiver having an oversized portion is also disclosed. In another aspect, the vessel or bag further includes a second receiver for receiving a portion of an external structure, such as a motive device, and aligning the vessel relative thereto.

22 Claims, 18 Drawing Sheets

Related U.S. Application Data

28, 2000, now Pat. No. 6,758,593, said application No. 11/829,194 is a continuation-in-part of application No. 11/496,702, filed on Jul. 31, 2006, now Pat. No. 7,434, 983, which is a continuation of application No. 10/398, 946, filed as application No. PCT/US01/31459 on Oct. 9, 2001, now Pat. No. 7,086,778, said application No. 11/829,194 is a continuation-in-part of application No. 10/491,512, filed as application No. PCT/US02/31478 on Oct. 2, 2002, now Pat. No. 7,481,572, said application No. 11/829,194 is a continuation-in-part of application No. 11/028,777, filed on Jan. 4, 2005, now Pat. No. 7,357,567, which is a continuation of application No. 10/120,006, filed on Apr. 10, 2002, now Pat. No. 6,837,613.

(60) Provisional application No. 60/239,187, filed on Oct. 9, 2000, provisional application No. 60/282,927, filed on Apr. 10, 2001, provisional application No. 60/318, 579, filed on Sep. 11, 2001, provisional application No. 60/326,833, filed on Oct. 3, 2001.

(56) References Cited

U.S. PATENT DOCUMENTS

| | | | | |
|---|---|---|---|---|
| 5,760,668 | A * | 6/1998 | Testa et al. | 335/285 |
| 5,941,867 | A * | 8/1999 | Kao | 604/416 |
| 6,758,593 | B1 * | 7/2004 | Terentiev | 366/273 |
| 6,786,349 | B2 * | 9/2004 | Najd | 220/484 |
| 7,267,479 | B2 * | 9/2007 | Terentiev | 366/273 |
| 8,182,137 | B2 * | 5/2012 | Terentiev | 366/279 |
| 2002/0112984 | A1 * | 8/2002 | Moran et al. | 206/569 |
| 2002/0145940 | A1 * | 10/2002 | Terentiev | 366/273 |
| 2005/0201201 | A1 * | 9/2005 | Terentiev | 366/273 |
| 2007/0263484 | A1 * | 11/2007 | Terentiev | 366/273 |

* cited by examiner

MIXING BAG OR VESSEL WITH A FLUID-AGITATING ELEMENT

This application is a continuation of Ser. No. 11/829,194, Jul. 27, 2007 now U.S. Pat. No. 8,182,137 the disclosure of which is incorporated by reference, which is: (1) a continuation-in-part of Ser. No. 11/113,677, Apr. 25, 2005 now U.S. Pat. No. 7,267,479 which is a continuation of Ser. No. 10/863,910, now U.S. Pat. No. 6,899,454, the disclosure of which is incorporated herein by reference, which is a divisional of U.S. patent application Ser. No. 09/724,815, Nov. 28, 2000 now U.S. Pat. No. 6,758,593, which claims the benefit of U.S. Provisional Application Ser. No. 60/239,187; (2) a continuation-in-part of Ser. No. 11/496,702, Jul. 31, 2006 now U.S. Pat. No. 7,434,983 which is a continuation of Ser. No. 10/398,946, Apr. 8, 2003 now U.S. Pat. No. 7,086,778 the disclosure of which is incorporated herein by reference, which is the national stage of PCT/US01/31459, filed Oct. 9, 2001, which claims the benefit of the following U.S. Provisional Patent Applications: (a) Ser. No. 60/239,187, filed Oct. 9, 2000; (b) Ser. No. 60/282,927, filed Apr. 10, 2001; and (c) Ser. No. 60/318,579, filed Sep. 11, 2001; (3) a continuation-in-part of Ser. No. 10/491,512, Apr. 1, 2004 now U.S. Pat. No. 7,481,572 which is the national stage of PCT/US02/31478, filed Oct. 2, 2002, the disclosure of which is incorporated herein by reference, which claims the benefit of U.S. Provisional Patent Application Ser. No. 60/326,833, filed Oct. 3, 2001; and (4) a continuation-in-part of Ser. No. 11/028,777, filed Jan. 4, 2005, now U.S. Pat. No. 7,357,567 the disclosure of which is incorporated herein by reference, which is a continuation of Ser. No. 10/120,006, filed Apr. 10, 2002, now U.S. Pat. No. 6,837,613.

TECHNICAL FIELD

The present invention relates generally to vessels in which fluids are agitated and, more particularly, to a vessel or bag including at least one receiver for receiving and holding a fluid-agitating element at a home location.

BACKGROUND OF THE INVENTION

Most pharmaceutical solutions and suspensions manufactured on an industrial scale require highly controlled, thorough mixing to achieve a satisfactory yield and ensure a uniform distribution of ingredients in the final product. Agitator tanks are frequently used to complete the mixing process, but a better degree of mixing is normally achieved by using a mechanical stirrer or impeller (e.g., a set of mixing blades attached to a metal rod). Typically, the mechanical stirrer or impeller is simply lowered into the fluid through an opening in the top of the vessel and rotated by an external motor to create the desired mixing action.

One significant limitation or shortcoming of such an arrangement is the danger of contamination or leakage during mixing. The rod carrying the mixing blades or impeller is typically introduced into the vessel through a dynamic seal or bearing. This opening provides an opportunity for bacteria or other contaminants to enter, which of course can lead to the degradation of the product. A corresponding danger of environmental contamination exists in applications involving hazardous or toxic fluids, or suspensions of pathogenic organisms, since dynamic seals or bearings are prone to leakage. Cleanup and sterilization are also made difficult by the dynamic bearings or seals, since these structures typically include folds and crevices that are difficult to reach. Since these problems are faced by all manufacturers of sterile solutions, pharmaceuticals, or the like, the U.S. Food and Drug Administration (FDA) has consequently promulgated strict processing requirements for such fluids, and especially those slated for intravenous use.

In an effort to overcome these problems, others have proposed alternative mixing technologies. Perhaps the most common proposal for stirring a fluid under sterile conditions is to use a rotating, permanent magnet bar covered by an inert layer of TEFLON, glass, or the like. The magnetic "stirrer" bar is placed on the bottom of the agitator vessel and rotated by a driving magnet positioned external to the vessel. An example of such an arrangement where the vessel is a flexible bag is shown in U.S. Pat. No. 5,947,703 to Nojiri et al., the disclosure of which is incorporated herein by reference.

Of course, the use of such an externally driven magnetic bar avoids the need for a dynamic bearing, seal or other opening in the vessel to transfer the rotational force from the driving magnet to the stirring magnet. Therefore, a completely enclosed system is provided. This of course prevents leakage and the potential for contamination created by hazardous materials (e.g., cytotoxic agents, solvents with low flash points, blood products, etc.), eases clean up, and allows for the desirable sterile interior environment to be maintained, all of which are considered significant advantages.

Despite the advantages of this type of mixing systems and others where the need for a shaft penetrating into the vessel or dynamic seal is eliminated, a substantial, but heretofore unsolved problem with such systems is the difficulty in coupling a fluid-agitating element with an external motive device providing the rotation and/or levitation force. For example, when a vessel in the form of a flexible bag containing an unconfined fluid-agitating element is positioned in proximity to the motive device, the relative location of the fluid-agitating element is generally unknown. In the case of a small (10 liter or less) transparent bag, it is possible to manipulate the bag relative to the motive device in an effort to ensure that the fluid-agitating element is "picked up" and the desired coupling is fainted. However, this is considered inconvenient and time consuming, especially if fluid is already present in the bag.

Moreover, in the case where the bag is relatively large (e.g., capable of holding 100 liters or more) or formed of an opaque material (e.g., black), achieving the proper positioning of the fluid-agitating element relative to the external motive device is at a minimum difficult, and in many cases, impossible. In the absence of fortuity, a significant amount of time and effort is required to lift and blindly reposition the bag relative to the motive device, without ever truly knowing that the coupling is properly formed.

Also, even if the coupling is initially formed, the fluid-agitating element may become accidentally decoupled or disconnected from the motive device during the mixing operation. In view of the semi-chaotic nature of such an event, the ultimate resting place of the fluid-agitating element is unknown and, in cases where the fluid is opaque (e.g., blood) or cloudy (e.g. cell suspensions), not easily determined. If the coupling ultimately cannot be established in the proper fashion, the desired fluid agitation cannot be achieved in a satisfactory manner, which essentially renders the set up useless. These shortcomings may significantly detract from the attractiveness of such fluid agitation systems from a practical standpoint.

In many past mixing arrangements, a rigid vessel is used with a fluid-agitating element directly supported by a post carrying a roller bearing, with the rotational force being supplied by an external device (see, e.g., U.S. Pat. No. 4,209,259 to Rains et al., the disclosure of which is incorporated herein by reference). While this direct support arrangement prevents the fluid-agitating element from being lost in the event of an accidental decoupling, the use of such post or like structure in a bag for receiving and holding a fluid-agitating element has not been proposed. The primary reason for this is that, in a typical flexible bag, neither the sidewalls nor any other structure is capable of providing the direct support for the fluid-agitating element or a corresponding bearing.

Thus, a need is identified for an improved manner of ensuring that the desired coupling may be reliably achieved between a fluid-agitating element in a vessel such as a bag and an external motive device, such as one supplying the rotational force that causes the element to agitate the fluid, even in large, industrial scale mixing bags or vessels (greater than 100 liters), opaque bags or vessels, or where the fluid to be agitated is not sufficiently clear, and even after an accidental decoupling occurs. The improvement provided by the invention would be easy to implement using existing manufacturing techniques and without significant additional expense. Overall, a substantial gain in efficiency and ease of use would be realized as a result of the improvement, and would greatly expand the potential applications for which advanced mixing systems may be used.

SUMMARY OF THE INVENTION

In accordance with a first aspect of the invention, a vessel intended for receiving a fluid and a fluid-agitating element is provided. The vessel comprises a bag capable of receiving and holding the fluid. The bag includes a rigid portion having a first receiver for receiving and holding the fluid-agitating element at a home location when positioned in the vessel.

In one embodiment, the first receiver is a first inwardly-projecting post for positioning in an opening or recess in the fluid-agitating element. The first post may include an oversized portion for capturing the fluid-agitating element. The oversized portion is preferably the head of the first post and is T-shaped, cross-shaped, Y-shaped, L-shaped, spherical, cubic, or otherwise formed having a shape that confines the fluid-agitating element to adjacent the post.

The bag may further include a second receiver projecting outwardly from the bag. The second receiver facilitates aligning the fluid-agitating element with an external structure, such as a motive device for levitating or rotating the fluid-agitating element. In one particularly preferred embodiment, the first receiver is a first, inwardly-projecting post and the second receiver is a second, outwardly-projecting post coaxial with the first inwardly-projecting post.

The first receiver may include a peripheral flange mating with a portion of the bag to create an interface along which a seal is formed. Instead of comprising a post, the first receiver may be cap-shaped and include a cavity facing the interior of the bag. Still another option is for the first receiver to include an generally upstanding peripheral sidewall over which the fluid-agitating element is received and a cavity adapted for receiving a portion of an external structure for rotating the fluid-agitating element. The first receiver may also include a bearing for directly engaging and supporting the fluid-agitating element in a non-levitating fashion.

In accordance with a second aspect of the invention, a vessel intended for use in receiving a fluid and a fluid-agitating element, such as a magnetic impeller, positioned adjacent to an external structure, such as a housing of a motive device for levitating and/or rotating the fluid-agitating element, is disclosed. The vessel comprises a bag capable of receiving and holding the fluid. The bag includes a first inwardly-projecting post for receiving and holding the fluid-agitating element at a home location when positioned in the bag and a receiver adapted for receiving at least a portion of the external structure and aligning the fluid-agitating element relative thereto.

In one embodiment, the body comprises a flexible portion and a rigid portion in which the first post and the receiver arc formed. The receiver may take the form of a second outwardly projecting post, with the first and second posts being coaxial. Alternatively, the receiver may be defined by a rigid, cap-shaped portion having a cavity and a peripheral flange connected to the flexible portion, with the cavity facing an interior of the body for receiving the fluid-agitating element when positioned therein. The first inwardly directed post may be positioned at least partially in the cavity of the receiver or may include a bearing for directly supporting the fluid-agitating element.

In accordance with a third aspect of the invention, the combination of a vessel and a fluid-agitating element is disclosed. The vessel comprises a flexible portion and a rigid portion including a receiver for receiving and holding a fluid-agitating element at a home location or expected position within the vessel. The combination may further include a motive device for at least rotating the fluid-agitating element in the vessel. The fluid-agitating element used in the combination may be at least partially magnetic and may also include at least one blade or vane. The vessel may be at least initially hermetically sealed with the fluid-agitating element positioned therein.

In accordance with a fourth aspect of the invention, the combination of a vessel and a fluid-agitating element is disclosed, with the vessel comprising a first receiver for receiving the fluid-agitating element. The first receiver includes an oversized portion for capturing the fluid-agitating element on the receiver, but the fluid-agitating element is free of direct attachment to the receiver. The vessel may further include a second receiver for receiving a portion of an external structure to assist in aligning the fluid-agitating element relative thereto. The first receiver is preferably a post and the oversized portion is a head end of the post that is T-shaped.

In accordance with a fith aspect of the invention, a vessel for receiving a fluid and a fluid-agitating element, such as an impeller, is disclosed. The vessel comprises a bag capable of receiving and holding the fluid and a rigid receiver connected to the bag. The receiver receives and holds the fluid-agitating element at a home location when positioned in the bag.

In one embodiment, the rigid receiver is cap-shaped and includes a peripheral flange connected to the bag to form a seal. Alternatively, the rigid receiver is positioned in contact with an interior surface of the bag. Still another alternative is to position the rigid receiver in contact with an exterior surface of the bag.

In accordance with a sixth aspect of the invention, a system for agitating a fluid is disclosed. The system comprises a fluid-agitating element and a vessel for receiving the fluid, the vessel including a flexible portion and a rigid portion. The rigid portion includes a receiver for receiving and holding the fluid-agitating element at a home location in the vessel. A motive device for at least rotating the fluid-agitating element may also form part of the system.

In one embodiment, the motive device also levitates the fluid-agitating element in the vessel. The fluid-agitating element is at least partially magnetic or ferromagnetic and the motive device includes a rotating drive magnet structure for forming a magnetic coupling with the fluid-agitating element, an electromagnetic structure for rotating and levitating the fluid-agitating element, or a superconducting element for both levitating and rotating the fluid-agitating element.

In accordance with a seventh aspect of the invention, a method of positioning a fluid-agitating element in a bag intended for receiving a fluid in need of agitation is disclosed. The method comprises the step of providing the bag with a rigid portion including a receiver for receiving and holding the fluid-agitating element at a home location when positioned in the bag. Preferably, the receiver includes a post projecting toward an interior of the bag, the fluid-agitating element includes an opening, and the providing step comprises inserting the post through the opening. Alternatively, the receiver may include a peripheral sidewall and a cavity facing an interior of the bag, in which case the providing step comprises positioning the fluid-agitating element in the cavity. Still another alternative is for the receiver to include a peripheral sidewall and a cavity facing an exterior of the bag, in which case the fluid agitating element includes an opening or recess and the providing step comprises positioning the peripheral sidewall of the receiver in the opening or recess.

In accordance with a seventh aspect of the invention, a method of agitating a fluid is disclosed. The method comprises providing a bag with a receiver for receiving and holding a fluid-agitating element at a home location within the bag, placing a fluid in the bag, and, rotating the fluid-agitating element. In one embodiment, the bag comprises a flexible portion and a rigid portion including the receiver, and the providing step includes connecting the rigid portion to the flexible portion. The step of placing a fluid in the bag is completed after the fluid-agitating element is received in the receiver. The fluid-agitating element may be at least partially magnetic or ferromagnetic, and the step of rotating may include forming a non-contact coupling with a motive device external to the bag. The providing step may include providing a bearing on the receiver for directly engaging and supporting the fluid-agitating element. The method may further include the steps of folding the bag for storage or shipping with the fluid-agitating element in the receiver and unfolding the bag before the placing step, or hermetically sealing the bag after the providing step. The placing step may also comprise introducing the fluid through a sterile fitting provided in the bag.

DETAILED DESCRIPTION OF THE INVENTION

Figure 1:
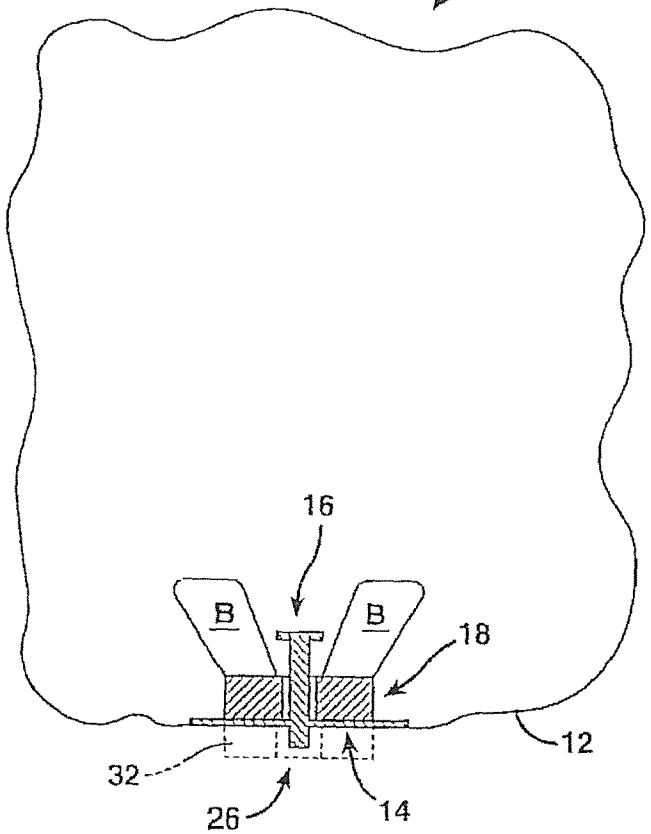
FIG. 1 is a partially schematic, partially cross-sectional side view of one embodiment of the present invention including a vessel in the form of a bag having a flexible portion and a rigid portion.

Reference is now made to FIG. 1, which discloses one embodiment of the vessel of the present invention in the form of a bag 10. In this embodiment, the bag 10 includes a body having a flexible or non-rigid portion 12, which is illustrated schematically, and a rigid or stiff portion 14, which is shown in cross-section. However, as outlined further in the description that follows, the use of the many of the present inventive concepts disclosed herein with vessels that are completely rigid is also possible.

The bag 10 may be hermetically sealed and may have one or more openings or fittings (not shown) for introducing or recovering a fluid. Alternatively, the bag 10 may be unsealed or open-ended. The particular geometry of the bag 10 employed normally depends on the application and is not considered critical to the invention. For example, in the case of a sterile fluid, a hermetically sealed, pre-sterilized bag with an aseptic fitting might be desirable; whereas, in the case where sterility is not important, an open-ended or unsealed bag might be suitable. The main important point is that the bag 10 is capable of receiving and at least temporarily holding a fluid (which is used herein to denote any substance capable of flowing, as may include liquids, liquid suspensions, gases, gaseous suspensions, or the like, without limitation).

The rigid portion 14 includes a first receiver 16 for receiving and holding a fluid-agitating element 18 at a home location (or expected position), when positioned in the bag 10. It is noted that "holding" as used herein defines both the case where the fluid-agitating element 18 is directly held and supported by the first receiver 16 (see below) against any significant side-to-side movement (save tolerances), as well as where the first receiver 16 merely limits the fluid-agitating element to a certain degree of side-to-side movement within the bag 10. In this embodiment, an opening 18*a* is provided in the fluid-agitating element 18 and the first receiver 16 is a post 20 projecting toward the interior of the bag 10 (see FIGS. 1*a* and 1*b*). The post 20 is sized for receiving the fluid-agitating element 18 by extending through the opening 18*a* formed in the body 18*b* thereof (which is depicted as being annular, but not necessarily circular in cross-section). As illustrated in FIG. 1, it is preferable that the size of the opening 18*a* is such that the fluid-agitating element 18 may freely rotate and move in the axial direction along the post 20 without contacting the outer surface thereof. Despite this freedom of movement, the post 20 serving as the first receiver 16 is still considered to hold, confine, or keep the fluid-agitating element 18 at a home location or expected position within the vessel 20 by contacting the surface adjacent to the opening 18*a* as a result of any side-to-side movement (the boundaries of which are defined by the dimensions of the opening).

The flexible portion 12 of the bag 10 may be made of thin (e.g., having a thickness of between 0.1 and 0.2 millimeters) polyethylene film. The film is preferably clear or translucent, although the use of opaque or colored films is also possible. The rigid portion 14 including the post 20 may be formed of plastic materials, such as high density polyethylene (HDPE), ultrahigh molecular weight (UHMW) polyethylene, or like materials. Of course, these materials do have some inherent flexibility when used to form relatively thin components or when a moderate amount of bending force is applied thereto. Despite this flexibility, the rigid portion 14 is distinguished from the flexible portion 12, in that it generally maintains its shape under the weight of any fluid introduced in the bag 10.

Figure 1B:
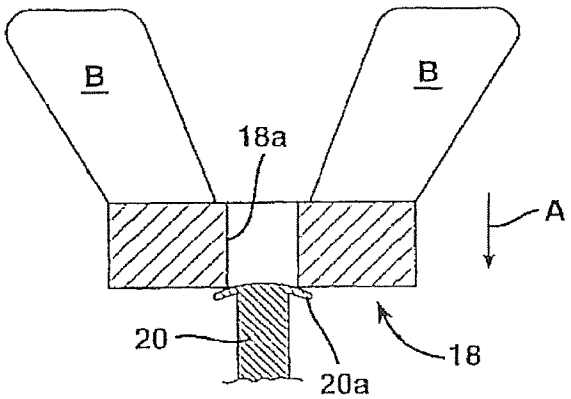
FIG. 1*b* is a partially schematic, partially cross-sectional, enlarged cutaway side view of the fluid-agitating element in the embodiment of FIG. 1.

Optionally, the post 20 may include a portion 20*a* for capturing the fluid-agitating element 18 and assisting in holding it thereon. The portion 20*a* is preferably oversized and forms the head or end of the post 20. By "oversized," it is meant that at least one dimension (length, width, diameter) of this portion 20*a* of the post 20 is greater than the corresponding dimension of the opening 18*a* in the fluid-agitating element 18. For example, the portion 20*a* is shown in FIG. 1 as being disc-shaped, such that it provides the head end of the post 20 with a generally T-shaped cross section. To prevent interference with the levitation and rotation of the fluid-agitating element 18, the oversized portion 20*a* is strategically positioned at a certain distance along the post 20. In the case where it is oversized, the post 20 may be removably attached to the rigid portion 14 through the opening 18*a* in the fluid-agitating element 18 (such as by providing a threaded bore in the rigid portion for receiving a threaded end of the post, or as shown in FIG. 1*c*, a bore 14*a* having a groove 14*b* for establishing a snap-fit engagement with a corresponding projection 20*b* on a tapered end portion 20*c* of the post). In the case where the post 20 is unitarily formed with the rigid portion 14 and includes an oversized head portion 20*a*, this portion should be sufficiently thin such that it flexes or temporarily deforms to allow the fluid-agitating element 18 to pass initially (see FIG. 1*b* and note action arrow A, which demonstrates the direction of force for deforming the oversized head 20*a* such that it passes through the opening 18*a*).

Alternatively, this portion 20*a* of the post 20 need not be oversized, as defined above, but instead may simply be sufficiently close in size to that of the opening 18*a* such that the fluid-agitating element 18 must be precisely aligned and register with the post 20 in order to be received or removed. In any case, it is again important to note that the fluid-agitating element 18 is held in place in the vicinity of the post 20, but remains free of direct attachment. In other words, while the first receiver 16 (post 20) confines or holds the fluid-agitating element 18 at a home location or expected position within the bag 10, it is still free to move side-to-side to some degree (which this case is defined by the size of the opening 18*a*), and to move along the first receiver 16 in the axial direction (vertical, in the embodiment shown in FIG. 1), as is necessary for levitation.

Figure 1A:
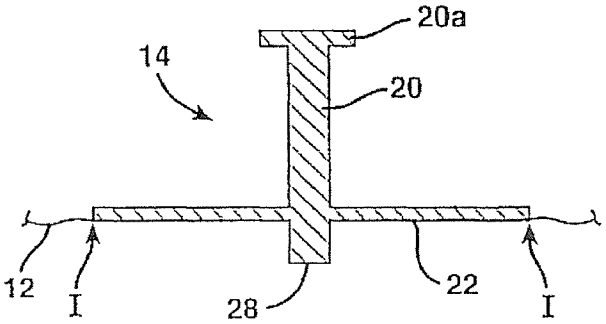
FIG. 1*a* is a partially schematic, partially cross-sectional, enlarged cutaway side view of the rigid portion of the vessel in the embodiment of FIG. 1.
Figure 1C:
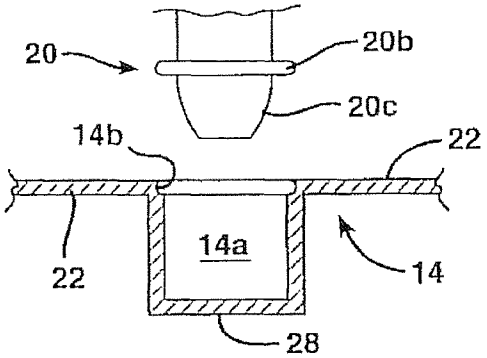
FIG. 1*c* is an enlarged partially cutaway side view showing one possible manner of attaching a first receiver in the form of a post to the rigid portion of the vessel.
Figure 16A:
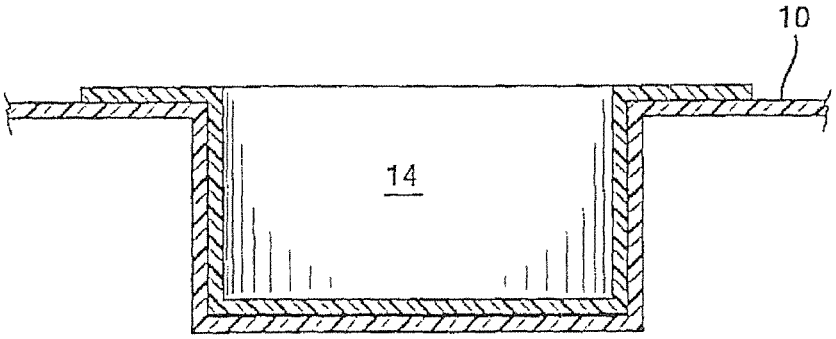
FIGS. 16*a* and 16*b* are enlarged, cross-sectional cutaway side views showing two different ways in which the rigid receiver may be connected to the bag forming the vessel.
Figure 16B:
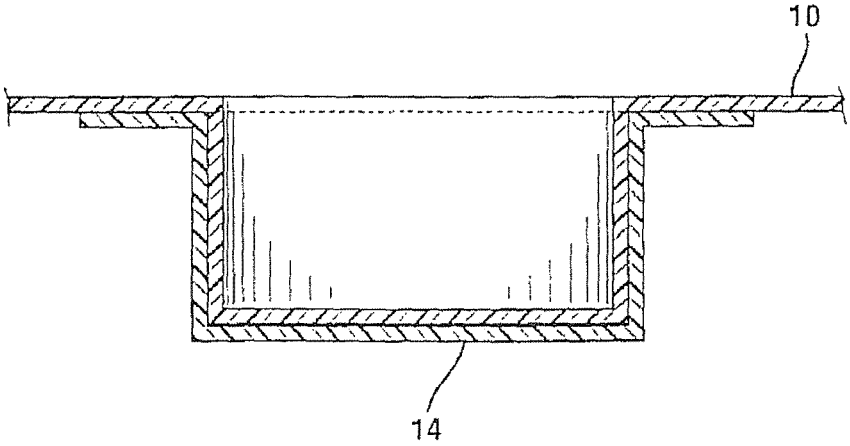

As perhaps best shown in FIG. 1*a*, the rigid portion 14 in this embodiment further includes a substantially planar peripheral flange 22. The flange 22 may be any shape or size, and is preferably attached or connected directly to the bag 10 at the interface I between the two structures (which may be created by overlapping the material forming the flexible portion 12 of the bag on an inside or outside surface of the flange 22 to form an overlapping joint, or possibly in some cases by forming a butt joint). In the case where the bag 10 and flange 22 are fabricated of compatible plastic materials, the connection may be made using well-known techniques, such as ultrasonic or thermal welding (heat or laser) at the interface to form a seal (which is at least liquid-impervious and preferably hermetic). Alternatively, other means of connection (e.g., adhesives), may be used at the interface I, although this is obviously less preferred in view of the desirability in most cases for the more reliable, leak-proof seal afforded using welding techniques. In either case, the judicious use of inert sealants may be made along the joint thus formed to ensure that a leak-proof, hermetic seal results. As discussed further below, the need for such an interface may be altogether eliminated by simply affixing the rigid portion 14 to an inside or outside surface of the bag 10 (see FIGS. 16*a* and 16*b*).

As should be appreciated, the bag 10 shown in FIG. 1 may be manufactured as described above, with the fluid-agitating element 18 received on the post 20 (which may be accomplished using the techniques shown in FIGS. 1*b* and 1*c*). The empty bag 10 may then be sealed and folded for shipping, with the fluid-agitating element 18 held at the home location by the post 20. Holding in the axial direction (i.e., the vertical direction in FIG. 1) may be accomplished by folding the bag 10 over the post 20, or by providing the portion 20*a* that is oversized or very close in size to the opening 18*a* in the fluid-agitating element 18.

When ready for use, the bag 10 is then unfolded. It may then be placed in a rigid or semi-rigid support structure, such as a container C, partially open along at least one end such that at least the rigid portion 14 remains exposed (see FIG. 2). Fluid F may then be introduced into the bag 10, such as through an opening or fitting (which may be a sterile or aseptic fitting, in the case where the bag 10 is pre-sterilized or otherwise used in a sterile environment). As should be appreciated, in view of the flexible or non-rigid nature of the bag 10, it will generally occupy any adjacent space provided in an adjacent support structure or container C when a fluid F (liquid or gas under pressure) is introduced therein (see FIG. 2).

Figure 2:
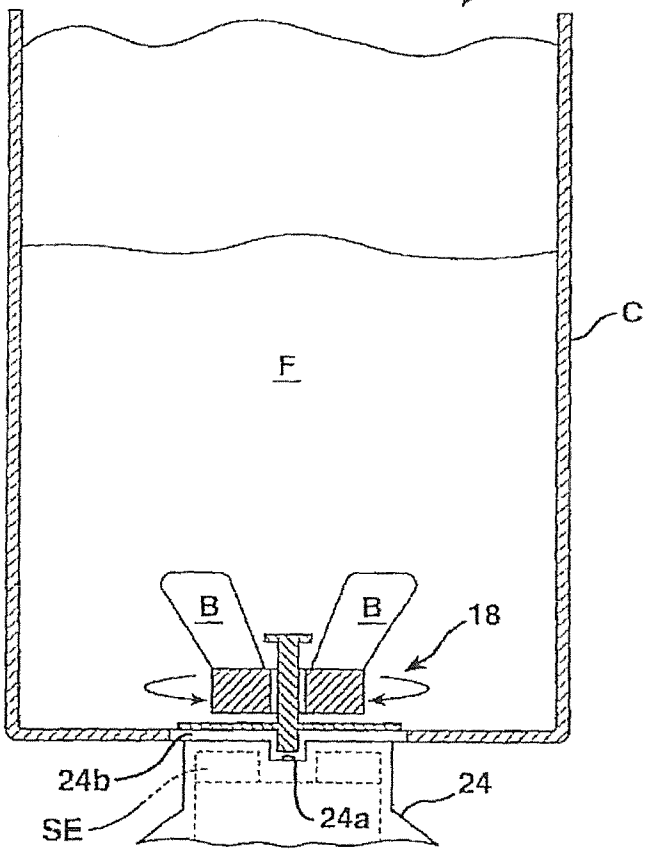
FIG. 2 is a partially schematic, partially cross-sectional side view showing the vessel of FIG. 1 positioned in a rigid vessel, with the fluid-agitating element aligned with and levitated/rotated by an adjacent motive device.

An external motive device 24 is then used to cause the fluid-agitating element 18 (which is at least partially magnetic or ferromagnetic) to at least rotate to agitate any fluid F in the bag 10. In the embodiment of FIG. 2, the fluid-agitating element 18 is at least partially magnetic and is shown as being levitated by the motive device 24, which is optional but desirable. The levitation may be provided by a field-cooled, thermally isolated superconducting element SE (shown in phantom in FIG. 2) positioned within the motive device 24 and thermally linked to a cooling source (not shown). As also described therein, the fluid-agitating element 18 may then be rotated by rotating the superconducting element SE (in which case the fluid-agitating element 18 should produce an asymmetric magnetic field, such as by using at least two spaced magnets having alternating polarities). Another option is to use a separate drive structure (e.g., an electromagnetic coil) to form a coupling capable of transmitting torque to the particular fluid-agitating element (which may be "levitated" by a hydrodynamic bearing; see, e.g., U.S. Pat. No. 5,141,327 to Shiobara). While it is of course desirable to eliminate the need for a dynamic seal or opening in the bag through which a drive structure (such as a shaft) extends, the particular means used to levitate and/or rotate the fluid-agitating element 18 is not considered critical to practicing the inventions disclosed herein.

The fluid-agitating element 18 is also depicted as including a plurality of vanes or blades B to improve the degree of fluid agitation. If present, the vanes or blades B preferably project in a direction opposite the corresponding surface of the rigid portion 14. The particular number, type, and form of the vanes or blades B is not considered important, as long as the desired degree of fluid agitation for the particular application is provided. Indeed, in applications where only gentle agitation is required, such as to prevent damage to delicate suspensions or to merely prevent stagnation of the fluid F in the bag 10, the vanes or blades B need not be provided, as a rotating smooth-walled annular element 18 still provides some degree of agitation.

As explained above, it is important to not only know the general location or position of the fluid-agitating element 18 within the bag 10, but also to assure its position relative to the motive device 24. To do so, and in accordance with a second aspect of the invention, the rigid portion 14 may be provided with a second receiver 26 to facilitate the correct positioning of the motive device 24 relative to the fluid-agitating element 18 when held at the home location. In the embodiment shown in FIGS. 1*a* and 1*b*, the second receiver 26 takes the form of a second post 28 projecting in a direction opposite the first post 20. Preferably, the second post 28 is essentially coaxial with the first post 20 (although the post 20 may be a separate component that fits into a receiver 14*a* defined by the second post 28; see FIG. 1*c*) and is adapted to receive an opening 24*a*, such as a bore, in the adjacent end face 24*b* forming a part of the housing for the motive device 24. Consequently, the second post 28 helps to assure that the alignment between the fluid-agitating element 18 (which is generally held in the vicinity of the first receiver 16/post 20, which is the home location) and the motive device 14 is proper such that the desired coupling for transmitting the levitation or rotational force may be formed.

Preferably, the second receiver 26, such as second post 28, has a cross-sectional shape corresponding to the shape of the opening 24*a*. For example, the second post 28 may be square in cross-section for fitting in a correspondingly-shaped opening 24*a* or locator bore. Likewise, the second post 28 could have a triangular cross-sectional shape, in which case the opening 28 would be triangular. Myriad other shapes could also be used, as long as the shape of the second receiver 26 compliments that of the opening 24*a* such that it may be freely received therein. In this regard, it is noted that a system of matching receivers and openings may be used to ensure that the fluid-agitating element 18 in the bag 10 corresponds to a particular motive device 24. For example, in the case where the fluid-agitating element 18 includes a particular arrangement of magnets producing a magnetic field that corresponds to a particular superconducting element or drive structure, the second receiver 26 may be provided with a certain shape that corresponds only to the opening 24 in the motive device 24 having that type of superconducting element or drive structure. A similar result could also be achieved using the relative sizes of the second receiver 26 and the opening 24*a*, as well as by making the size of the opening 18*a* in the fluid-agitating element 18 such that it only fits on a first receiver 16 having a smaller width or diameter, and then making the second receiver 26 correspond only to an opening 24*a* in a motive device 24 corresponding to that fluid-agitating element 18.

In many past arrangements where a rigid vessel is used with a fluid-agitating element directly supported by a bearing, an external structure is provided to which a motive device could be directly or indirectly attached and held in a suspended fashion (see, e.g., U.S. Pat. No 4,209,259 to Rains et al., the disclosure of which is incorporated herein by reference). This structure serves to automatically align the motive device with the fluid-agitating element supported therein. However, a bag 10 per se is generally incapable of providing reliable support for the motive device 24, which can weigh as much as twenty kilograms. Thus, the motive device 24 in the embodiments disclosed herein for use with a vessel in the form of a bag 10 is generally supported from a stable support structure (not shown), such as the floor, a wheeled, height adjustable platform, or the like. Since there is thus no direct attachment with the bag 10, the function performed by the second receiver 26 in aligning this device with the fluid-agitating element 18 is an important one.

Figure 3B:
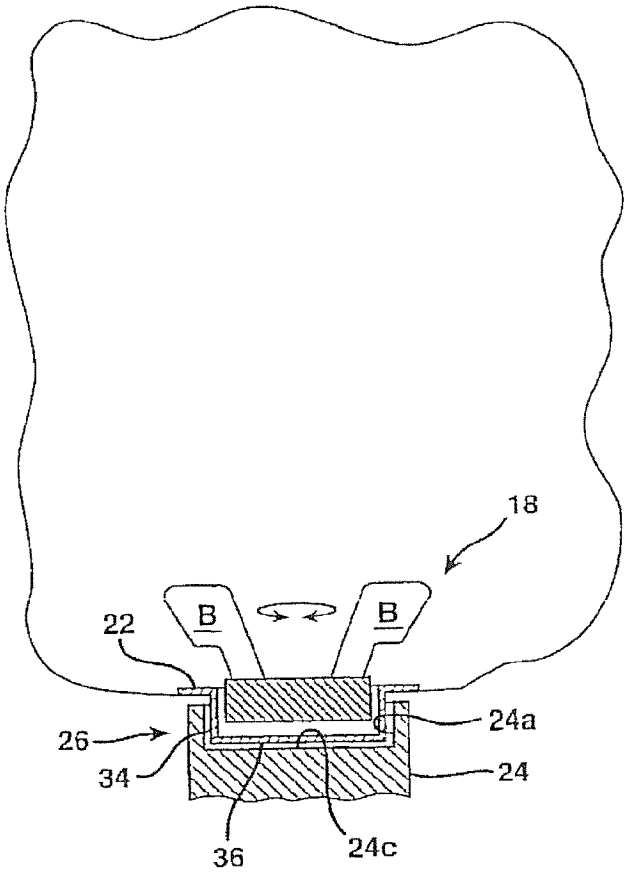
FIG. 3*b* is a side view similar to FIG. 3*a;*
Figure 3A:
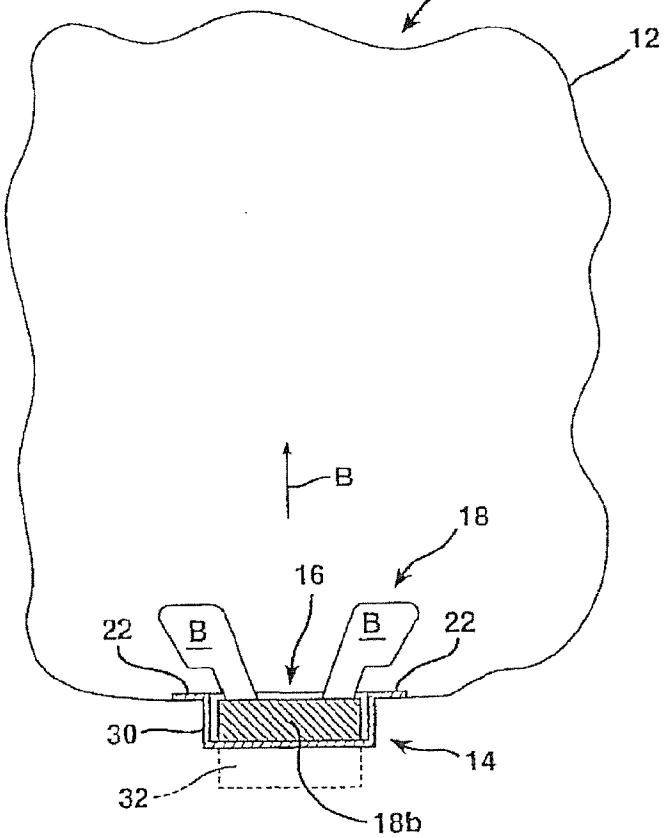
FIG. 3*a* is partially schematic, partially cross-sectional side view showing another embodiment of the vessel, including a hat or cap-shaped rigid portion having a cavity facing inwardly.

Another embodiment of the vessel forming one aspect of the present invention is shown in FIGS. 3*a* and 3*b*. In this embodiment, the vessel is again a bag 10 including a flexible portion 12 and a rigid portion 14. The rigid portion 14 is cap or hat-shaped with a peripheral flange 22 for attachment to the flexible portion 12 of the bag 10. The connection between the two structures may be formed using the various techniques described above, and preferably results in a fluid-impervious, hermetic seal. The rigid portion 14 includes a first receiver 16 in the form of a recess or cavity 30 facing the interior of the bag (see action arrow B) for receiving a correspondingly-shaped portion of the fluid-agitating element 18 in the bag 10 and holding it at a home location, at least when oriented as shown in FIG. 3*a*. The portion of the fluid-agitating element 18 received in the cavity 30 is preferably the body 18*b*, which as described above is at least partially magnetic or ferromagnetic and may optionally support a plurality of vanes or blades B. Preferably, the body 18*b* of the fluid-agitating element 18 is circular in cross-section and the cavity 30 is sized and shaped such that the body (which need not include opening 18*a* in view of the absence of post 20) may freely be inserted, rotate, and levitate therein. However, as with the first embodiment, the fluid-agitating element 18 could also be in the form of a conventional magnetic stirrer (which of course would not be levitated), such as a bar having a major dimension less than the corresponding dimension (e.g., the diameter) of the cavity 30. In any case, the fluid-agitating element 18 in this embodiment is again free of direct attachment from the first receiver 16, but is held at a home location, even in the event of accidental decoupling.

Thus, in the manner similar to that described above with respect to the first embodiment, the fluid-agitating element 18 may be positioned in the first receiver 16 in the bag 10. The bag 10 may then be sealed, folded for storage or shipping, stored or shipped, and ultimately unfolded for use. The folding is preferably completed such that the fluid-agitating element 18 is captured in the cavity 30 and remains held in place during shipping by an adjacent portion of the bag 10. Consequently, upon unfolding the bag 10, the fluid-agitating element 18 is at the expected or home location, but remains free of direct attachment and ready to be rotated (and possibly levitated). If levitated, the levitation height established by the superconducting bearing or hydrodynamic bearing is preferably such that at least a portion of the body 18*b* of the fluid-agitating element 18 remains within the confines of the cavity 30. This helps to assure that the fluid-agitating element 18 remains held at the home location (that is, in the vicinity of the first receiver 16), even in the case of accidental decoupling from the motive device 24. In other words, in the event of an accidental decoupling, the fluid-agitating element 18 will engage the sidewall of the cavity 30 and simply come to rest therein, which defines the home location. This not only improves the chance of an automatic recoupling, but also makes the task of manually reforming the coupling an easy one.

An option to assure that a magnetic fluid-agitating element 18 remains associated with the first receiver 16, even if inverted, is to attach an attractive structure, such as a magnet 32 (shown in phantom in FIG. 3*a*), to the exterior of the rigid portion 14. The non-contact coupling thus established helps ensure that the fluid-agitating element 18 remains in the home location prior to being coupled to an external motive device. The magnet 32 is removed once the bag 10 is positioned on or in a support structure, such as a container C (see FIG. 2). Such a magnet 32 may also be used with the embodiment of FIG. 1, which eliminates the need for providing the post 20 with portion 20*a*. The magnet 32 is preferably annular with an opening that is received by the second receiver 26, which advantageously helps to ensure that the alignment is proper for forming the coupling.

Yet another option is to provide a frangible adhesive on the fluid-agitating element 18 to hold it in place temporarily in the first receiver 16 prior to use. The strength of any adhesive used is preferably such that the bond is easily broken when the fluid-agitating element 18 is levitated in the first receiver 16. Of course, the use of such an adhesive might not be possible in situations where strict regulations govern the purity of the fluid being mixed.

With reference to FIG. 3*b*, the first receiver 16 in this embodiment also serves the dual function of helping to align the fluid-agitating element 18 relative to an external motive device 24. Specifically, the periphery of the sidewall 34 and the end wall 36 defining the cavity 30 in the rigid portion 14 define a second receiver 26 adapted to receive an opening 24*a* formed in an adjacent face of a motive device 24. As described above, the opening 24*a* is preferably sized and shaped for being received by the second receiver 26, and may even help to ensure that the bag 10 is used only with a motive device 24 having the correct superconducting element or magnetic structure(s) for levitating and/or rotating the fluid-agitating element 18. For example, in the case where the sidewall 34 and end wall 36 provide the second receiver 26 with a generally cylindrical shape, the opening 24*a* is also cylindrical. Preferably, the opening 24*a* also has a depth such that the end wall 36 rests on the corresponding face 24*c* of the motive device 24. This feature may be important to ensure that the gap between the superconducting element and/or drive structure in the motive device 24 and the at least partially magnetic or ferromagnetic body 18*b* of the fluid-agitating element 18 is minimized, which helps to ensure that the strongest possible coupling is established and that the maximum amount of driving torque is transferred. The gaps are shown as being oversized in FIG. 3*b* merely to provide a clear depiction of the relative interaction of the structures shown. However, in the case where the entire housing of the motive device 24 is rotated, it may be desirable to provide a certain amount of spacing between the sidewall 34, the end wall 36, and the corresponding surfaces defining the opening 24*a* to avoid creating any interference.

Figure 4B:
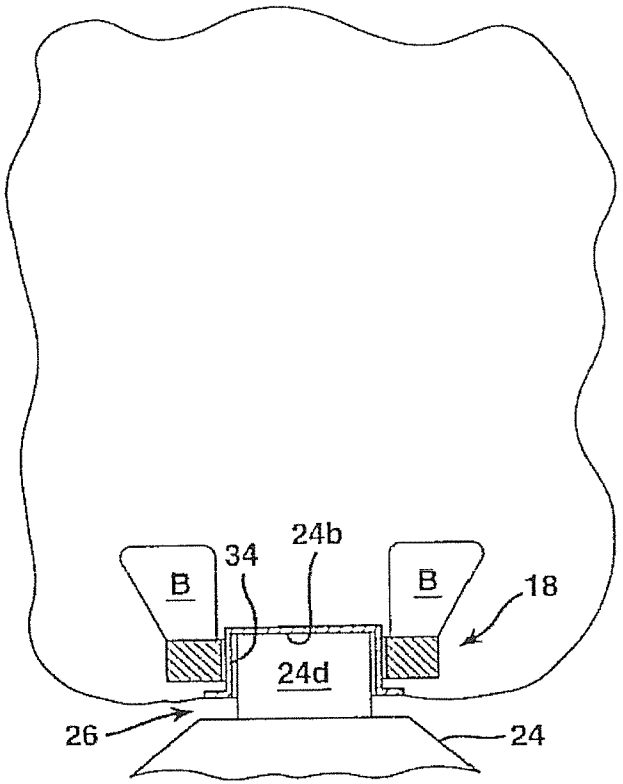
FIG. 4*b* is a side view similar to FIG. 4*a;*
Figure 4A:
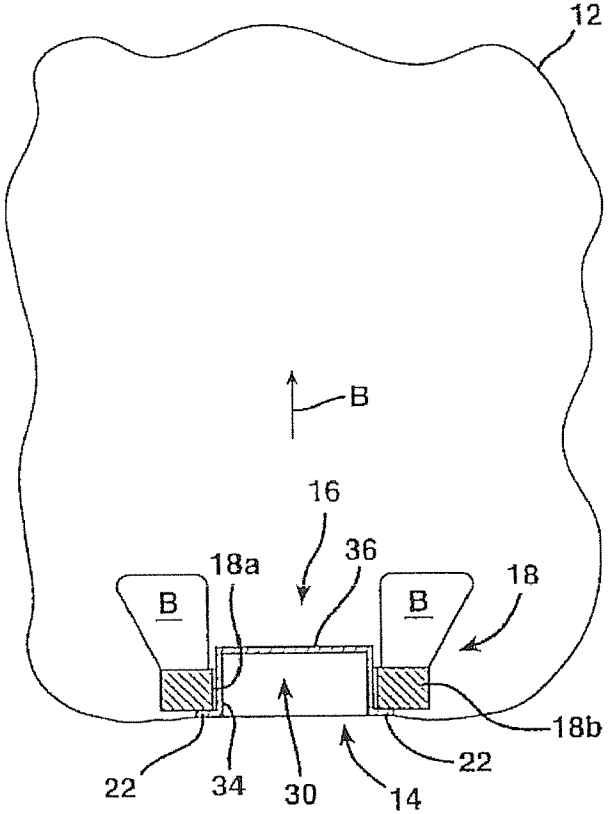
FIG. 4*a* is partially schematic, partially cross-sectional side view showing another embodiment of the vessel, including a hat or cap-shaped rigid portion having a cavity facing outwardly.

FIGS. 4*a* and 4*b* show an embodiment similar in some respects to the one shown in FIGS. 3*a* and 3*b*. For example, the rigid portion 14 includes a peripheral flange 22 connected to the flexible portion 12 of the bag 10 to form a seal. Also, the rigid portion 14 includes a sidewall 34 and end wall 26 that together define a cavity 30. However, a major difference is that the cavity 30 of the rigid portion 14 essentially faces outwardly, or toward the exterior of the bag 10 (e.g., in a direction opposite action arrow B). Consequently, the sidewall 34 and end wall 36 define the first receiver 16 for receiving the fluid-agitating element 18, which is shown having an annular body 18*b* that is at least partially magnetic or ferromagnetic and may support a plurality of vanes or blades B. As should be appreciated, the first receiver 16 in the form of the periphery of the sidewall 34 provides a similar receiving function as both the post 20 and the cavity 30 of the other embodiments, since it is capable of maintaining, holding, or confining the fluid-agitating element 18 substantially in a home or expected position within the bag 10. The maximum amount of side-to-side movement is of course dependent on the size of the opening 18*a* in the fluid-agitating element.

Additionally, the outwardly-facing cavity 30 is adapted to serve as the second receiver 26 for receiving a portion of a motive device 24 used to levitate and rotate the fluid-agitating element 18 and serving to align the two. Specifically, the motive device 24 may include a head end 24*d* adapted for insertion in the cavity 30 to form the desired coupling with the fluid-agitating element 18 positioned adjacent thereto. As with the embodiments described above, the spacing between the head end 24*d* and at least the sidewall 34 is preferably minimized to maximize the strength of the coupling between the motive device 24 and the fluid-agitating element 18. Moreover, in view of the rigid nature of the rigid portion 14, the end face 24*b* of the head end 24*d* may rest against and assist in supporting the bag 10 (which, as described above, may be positioned in a separate, semi-rigid container (not shown)).

In each of the above-referenced embodiments, the possible use of a levitating fluid-agitating element 18 with a superconducting bearing or a hydrodynamic bearing is described. In such systems, a real possibility exists that the fluid-agitating element 18 might accidentally decouple or disconnect from the motive device 24, such as if the fluid is viscous or the amount of torque transmitted exceeds the strength of the coupling. In a conventional bag, the process of reestablishing the coupling is extraordinarily difficult, since the location of the fluid-agitating element 18 within the bag 10 is unknown. In a sterile environment, opening the bag 10 and using an implement to reposition or "fish" out the fluid-agitating element 18 is simply not an option. Thus, an added advantage of the use of the first receiver 16 in each of the above-referenced embodiments is that, despite being free from direct attachment, it still serves the function of holding the fluid-agitating element 18 at the home location in instances where accidental decoupling occurs. This significantly reduces the downtime associated with such an event, since the general position of the fluid-agitating element 18 is known. The use of a first receiver in the bag 10 also improves the chances of automatic recoupling, since the fluid-agitating element 18 remains generally centered relative to the motive device 14 and held generally at the home location, even when decoupling occurs.

A related advantage is provided by forming the first receiver 16 in or on a rigid portion 14 of the bag 10. Specifically, in the case where a fluid-agitating element rests on a surface of a bag, the contact over time could result in damage and could even lead to an accidental perforation, which is deleterious for obvious reasons. The possibility for such damage or perforation also exists when a levitating fluid-agitating element 18 accidentally decouples. Advantageously, the potential for such damage or perforation is substantially eliminated in the foregoing embodiments, since the first receiver 16 helps to keep the fluid-agitating element 18 adjacent to the flange 22 of the rigid portion 14, which is generally thicker and less susceptible to being damaged or perforated. In other words, if the fluid-agitating element 18 becomes decoupled, it only engages or contacts the rigid portion 14 of the bag 10. Thus, it is preferable for the flange 22 to be oversized relative to the fluid-agitating element 18

While the embodiments of FIGS. 1-4 are described as bags 10 including both a flexible portion 12 and a rigid portion 14, it should be appreciated that the present invention extends to a completely rigid vessel (that is, one made of metal, glass, rigid plastics, or the like). In the case of a rigid vessel, the post 20 preferably includes a portion 20*a* for capturing the fluid-agitating element 18 thereon, but without any other means of direct attachment or bearing.

Figure 5B:
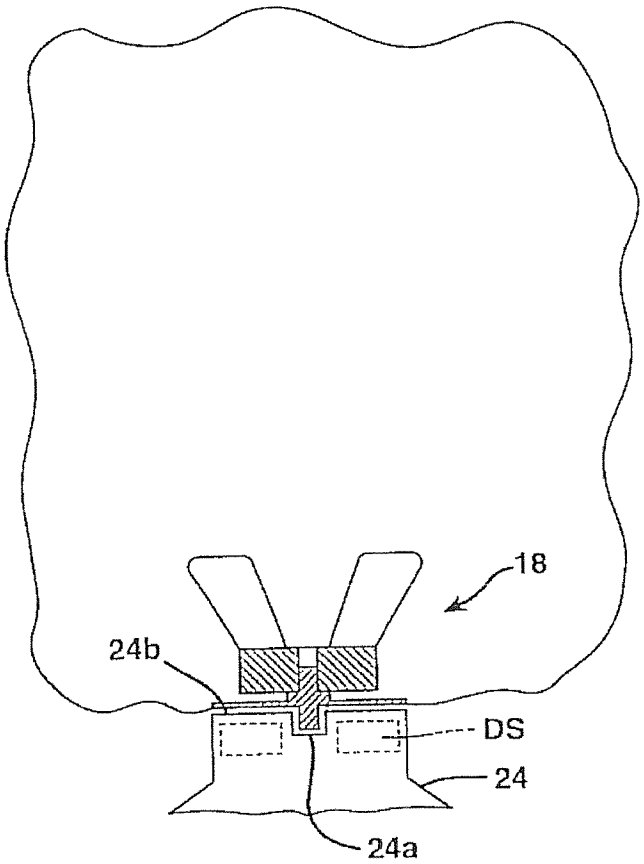
FIGS. 5*a*, 5*b*, 6*a*, 6*b*, and 7*a*, 7*b* are each partially schematic, partially cross-sectional side views of a vessel with a rigid portion for aligning a fluid-agitating element with a external structure, wherein the fluid-agitating element is directly supported by a slide bearing.
Figure 5A:
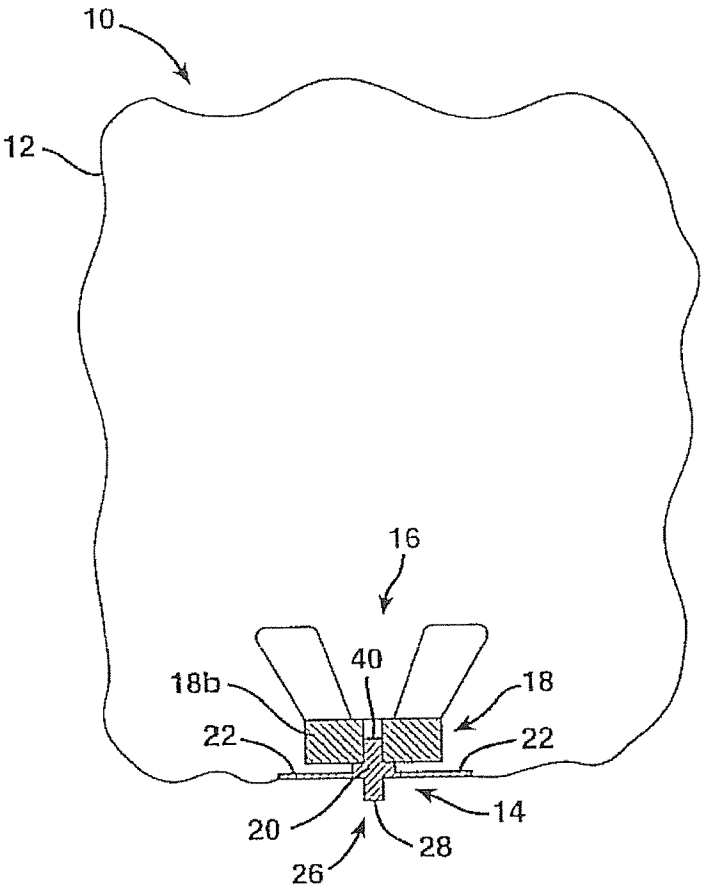

Up to this point, the focus has been on a fluid-agitating element 18 capable of levitating in the vessel. However, as briefly noted above, the inventions described herein may also be applied to a bag 10 in combination with a fluid-agitating element 18 directly supported by one or more bearings. For example, as shown in FIGS. 5*a* and 5*b*, the first receiver 16 associated with the rigid portion 14 of the bag 10 may be in the form of an inwardly-projecting post 20 including a slide bearing 40 for providing direct support for the fluid-agitating element 18. The bearing 40 is preferably sized and shaped such that it fits into an opening 18*a* foi ming in the fluid-agitating element 18, which may rest on the adjacent surface of the post 20 or may be elevated slightly above it. In either case, it should be appreciated that the first receiver 16 receives and holds the fluid-agitating element 18 in a home location, both during shipping and later use.

In view of the direct nature of the support, the material forming the slide bearing 40 is preferably highly wear-resistant with good tribological characteristics. The use of a slide bearing 40 is preferred in applications where the bag 10 is disposable and is merely discarded, since it is less expensive than a corresponding type of mechanical roller bearing (and is actually preferred even in the case where the bag 10 is reused, since it is easier to clean). However, it is within the broadest aspects of the invention to provide the first receiver 16 with a conventional roller bearing for providing direct, low-friction, rolling support for the rotating fluid-agitating element 18, although this increases the manufacturing expense and may not be acceptable in certain applications.

The rigid portion 14 of the bag 10 in this embodiment may further include a second receiver 26 in the form of a second post 28 coextensive and coaxial with the first post 20. The second post 28 is received in an opening 24*a* fainted in an end face 24*b* of a motive device 24. In view of the direct support provided for the fluid-agitating element 18 by the bearing 40, the motive device 24 in this case includes only a drive structure DS (shown in phantom in FIG. 5*b*) for forming a coupling with the body 18*b*, which is magnetic or ferromagnetic (iron, magnetic steel, etc.). The drive structure DS may be a permanent magnet or may be ferromagnetic, as necessary for forming the coupling with the fluid-agitating element 18, which may be disc-shaped, cross-shaped, an elongated bar, or have any other suitable shape. The drive structure DS may be rotated by a direct connection with a motor (not shown), such as a variable speed electric motor, to induce rotation in the fluid-agitating element 18. Alternatively, the drive structure DS may be an electromagnet with windings to which current is supplied to cause the magnetic fluid-agitating element 18 rotate and possibly levitate slightly to create a hydrodynamic bearing (see, e.g., U.S. Pat. No. 5,141,327, the disclosure of which is incorporated herein by reference). Again, it is reiterated that the particular type of motive device 24 employed is not considered critical to the present invention.

Figure 6B:
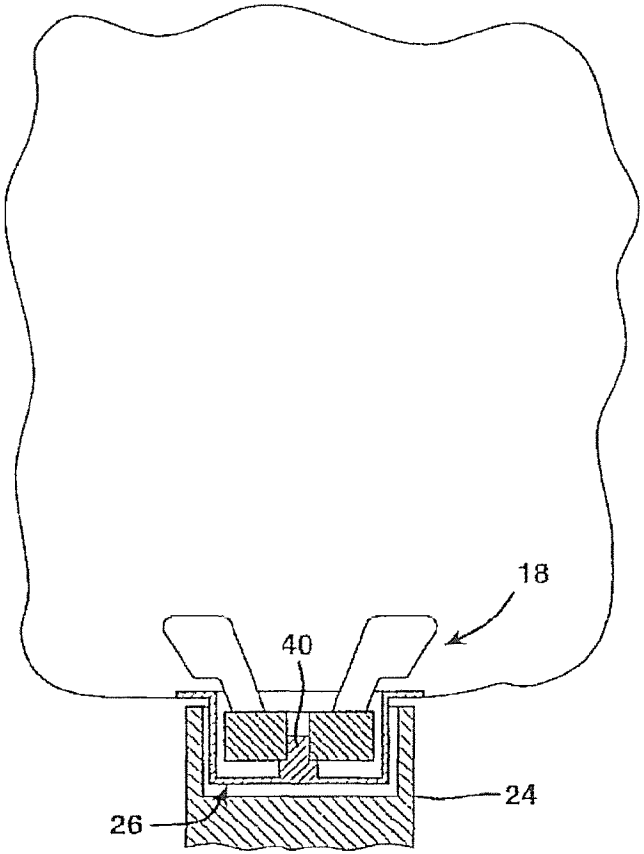
Figure 6A:
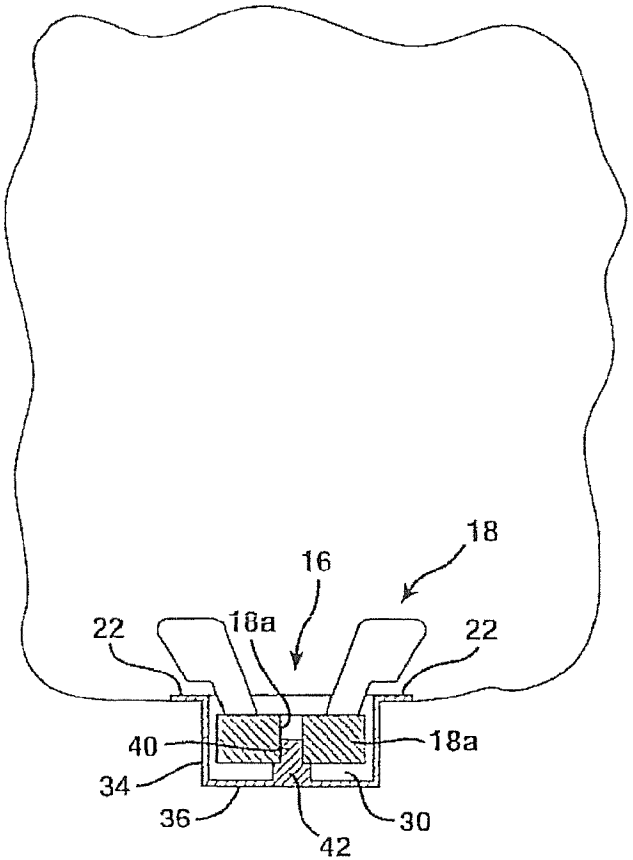

FIGS. 6*a* and 6*b* show an embodiment of the bag 10 in which the first receiver 16 is in the form of a cavity 30 formed in the rigid portion 14 and facing inwardly. A bearing 40 is provided in the cavity 30 for providing direct support for a fluid-agitating element 18 positioned therein. As with the embodiment described immediately above, the bearing 40 may be a slide bearing adapted for insertion in the opening 18*a* of the fluid-agitating element 18 formed on the head end of a post 42. The post 42 may be supported by or unitarily formed with the end wall 36. Despite the depiction of a slide bearing 40, it is reiterated that the particular type of bearing used is not considered critical, as long as rotational support is provided for the fluid-agitating element 18 and the other needs of the particular fluid-agitating operation are met (e.g., low friction, reduced expense, easy clean-up, etc.).

The body 18*b* of the fluid-agitating element 18, which is at least partially magnetic or ferromagnetic, is sized to fit within the sidewall 34 defining the cavity 30 and, thus, is capable of rotating therein as the result of an externally-applied, non-contact motive force. The periphery of the sidewall 34 also defines a second receiver 26 for receiving a corresponding opening 24*a* in a motive device 24, which in view of the direct support provided by bearing 40 need only provide the force necessary to rotate die fluid-agitating element 18 in a non-contact fashion.

Figure 7B:
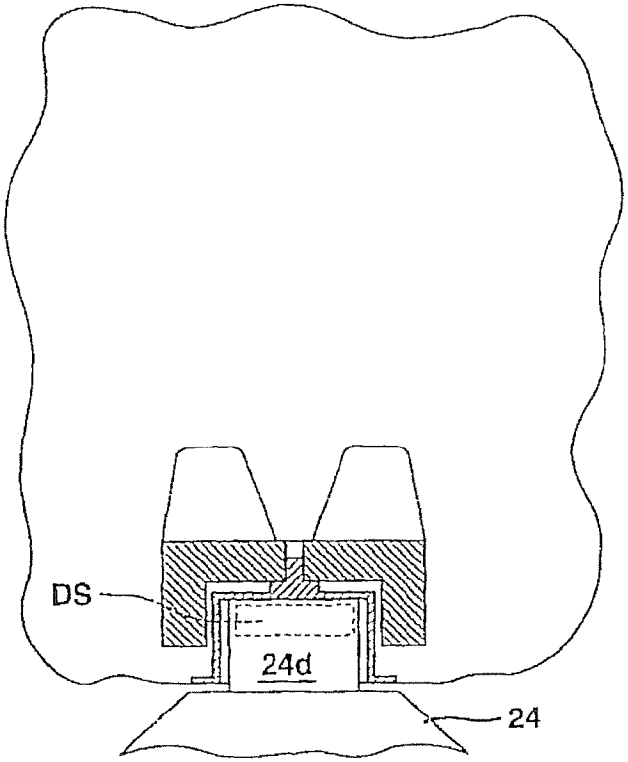
Figure 7A:
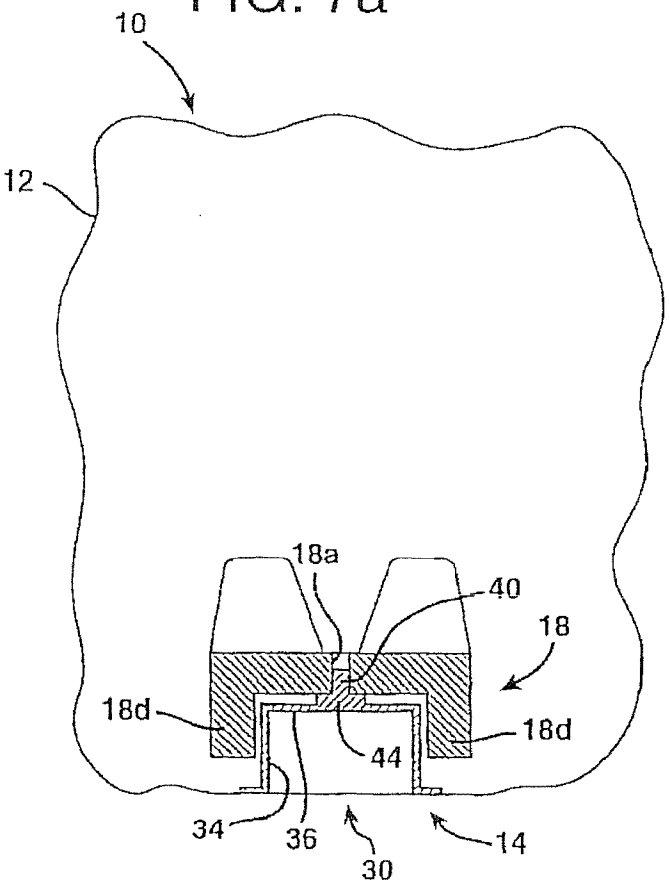

As should be appreciated, the embodiment shown in FIGS. 7*a* and 7*b* is the direct support counterpart for the embodiment shown in FIGS. 4*a* and 4*b*. The rigid portion 14 again includes a cavity 30 facing outwardly or toward the exterior of the bag 10 and a first receiver 16 for receiving and defining a home location for a fluid-agitating element 18. The first receiver 16 includes a bearing 40 for supporting the fluid-agitating element 18, which again is at least partially magnetic or ferromagnetic. The bearing 40 may be a slide bearing formed on the head end of a post 44 integral with the end wall 36 of the rigid portion 14 and adapted for fitting into an opening or recess 18*a* in the fluid-agitating element 18, or may be a different type of bearing for providing support therefor.

The motive device 24 includes ahead end 24*d* adapted for insertion in a second receiver 26 defined by the cavity 30. This head end 24*d* preferably includes the drive structure DS that provides the force for causing the at least partially magnetic or ferromagnetic fluid-agitating element 18 to rotate about bearing 40. In FIGS. 7*a* and 7*b*, it is noted that the fluid-agitating element 18 includes an optional depending portion 18*b* that extends over the sidewall 34. As should be appreciated, this portion may also be magnetized or ferromagnetic such that a coupling is formed with the drive structure DS. A similar type of fluid-agitating element 18 could also be used in the levitation scheme of FIGS. 4*a* and 4*b*.

Figure 8B:
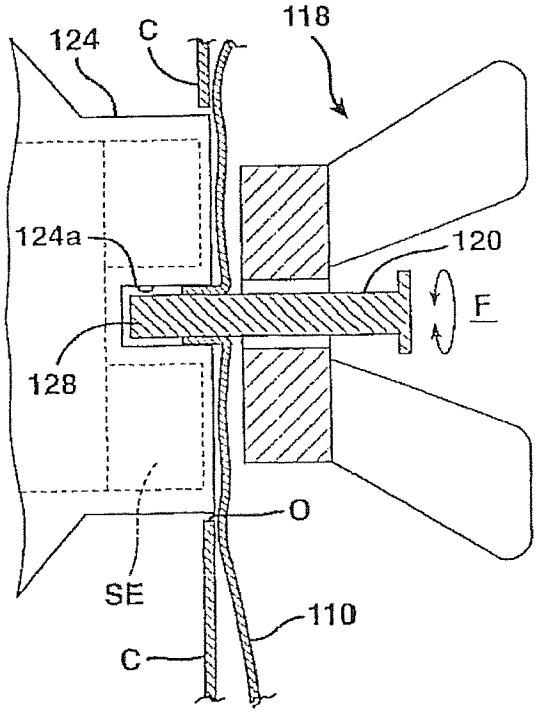
FIGS. 8*a* and 8*b* are enlarged, partially cross-sectional, partially cutaway side views of yet another embodiment of the vessel of the present invention.
Figure 8A:
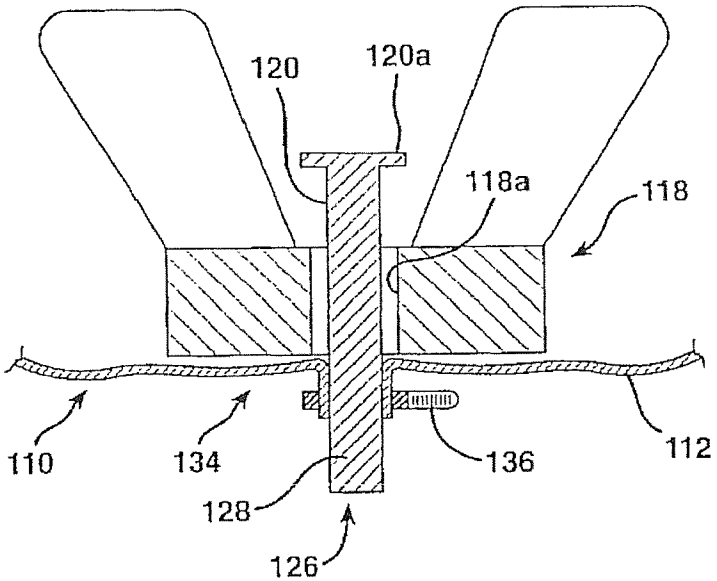

Various other modifications may be made based on the foregoing teachings. For example, FIGS. 8*a* and 8*b* show another possible embodiment of a vessel of the present invention for use in a fluid-agitating or mixing system. The vessel for holding the fluid is shown as being a bag 110 having a flexible portion 112, generally cylindrical in shape, and substantially or hermetically sealed from the ambient environment. In this embodiment, the bag 110 includes a first receiver 116 for receiving and holding the fluid-agitating element 118 at a home location. The first receiver 116 is in the form of a post 120 adapted to receive the fluid-agitating element 118, which has a corresponding opening 118*a*. The post 120 preferably includes an oversized head portion 120*a* that captures the fluid-agitating element 118, both before and after a fluid is introduced into the bag 110. Thus, the bag 110 may be manufactured, sealed (if desired), shipped, or stored prior to use with the fluid-agitating element 118 held in place on the post 120. The vessel 110 may also be sterilized as necessary for a particular application, and in the case of a flexible bag, may even be folded for compact storage. As should be appreciated, the post 120 also serves the advantageous function of keeping, holding, maintaining, or confining the fluid-agitating element 118 substantially at a home location or "centered," should it accidentally become decoupled from the adjacent motive device, which as described above may include a rotating superconducting element SE for not only providing the rotational force, but also a levitation force.

In this particular embodiment, the post 120 is shown as being defined by an elongated, rigid or semi-rigid, rod-like structure inserted through an opening typically found in the flexible plastic bags frequently used in the bioprocessing industry (pharmaceuticals, food products, cell cultures, etc.), such as a rigid or semi-rigid fitting or nipple 134. Despite the general rigidity of the post 120, the oversized portion 120*a*, which is shown as being T-shaped in cross-section, is preferably sufficiently thin and/or formed of a material that may flex or deform to easily pass through the opening in the nipple 134, as well as through the opening 118*a* in the fluid-agitating element 118. A conventional clamp 136, such as a cable tie, may be used to form a fluid-impervious seal between the nipple 134 and the post 120. Any other nipples or fittings present may be used for introducing the fluid F prior to mixing, retrieving a fluid during mixing or after mixing is complete, or circulating the fluid. Advantageously, the use of the rod/nipple combination allows for easy retrofitting. The oversized head portion 120*a* may be cross-shaped, L-shaped, Y-shaped, spherical, cubic, or may have any other shape, as long as the corresponding function of capturing the fluid-agitating element 118 is provided. The head portion 120*a* may be integrally formed, or may be provided as a separate component clamped or fastened to the post 120.

In accordance with another aspect of this embodiment of the invention, the bag 110 may also include a second receiver 126 that helps to ensure that proper alignment is achieved between the fluid-agitating element 118 and an adjacent structure, such as a support structure or a device for rotating and/or levitating the element. In the embodiment of FIGS. 8*a* and 8*b*, this second receiver 126 is shown as the opposite end 128 of the rod forming post 120. This end 128 of the rod may be inserted in a bore or opening 124*a* in an adjacent surface of a motive device 124 to assure proper alignment with the fluid-agitating element 118. In other words, as a result of the use of first and second receivers 116, 126, assurance is thus provided that the fluid-agitating element 118 is in the desired home or expected position for forming a coupling with an adjacent motive device 124.

FIG. 8*a* also shows the post 120 forming the first receiver 116 as projecting upwardly from a bottom wall of the vessel 110, but as should be appreciated, it could extend from any wall or other portion thereof. For example, as illustrated in FIG. 8*b*, the rod serving as both the first and second receivers 116, 126 may be positioned substantially perpendicular to a vertical plane. Specifically, in the particular embodiment shown, the bag 110 is positioned in a rigid or semi-rigid support container C having an opening O. Once the bag 110 is inserted in the container C, but preferably prior to introducing a fluid, the end 128 of the rod is positioned in the opening O such that it projects therefrom and may be inserted in the opening 124*a* formed in the motive device 124, which includes a superconducting element SE and may still levitate, and possibly rotate the at least partially magnetic fluid-agitating element 118 in this position. This ensures that the fluid-agitating element 118 is in the desired position to form the coupling necessary for levitation and/or rotation. Preferably, the portion of the rod extending outside the bag 110 and forming the second receiver 126 is greater in length than that in the embodiment shown in FIG. 1, and the depth of the opening 124*a* in the motive device 124 corresponds to this length. This in combination with the rigid or semi-rigid nature of the nipple 134 helps to ensure that the other end of the rod forming post 120 is properly aligned with the fluid-agitating element 118 when the magnetic coupling is formed.

Figure 9:
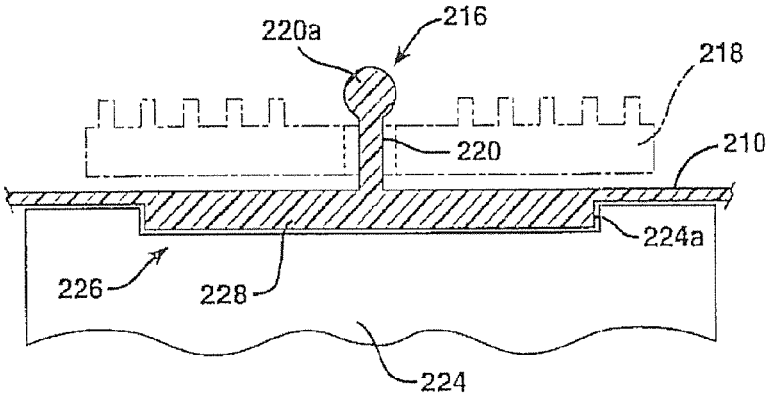
FIG. 9 is an enlarged, partially cross-sectional, partially cutaway side view of yet another embodiment of the vessel of the present invention.
Figure 9A:
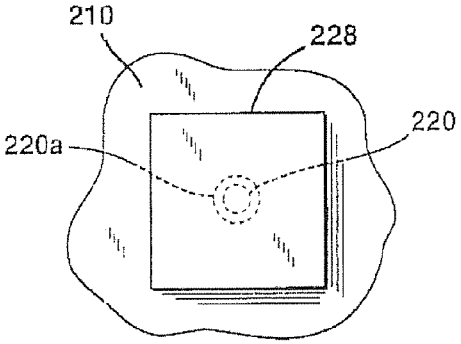
FIGS. 9*a* and 9*b* are cutaway bottom views of the vessel of FIG. 9*a* showing two different embodiments.
Figure 9B:
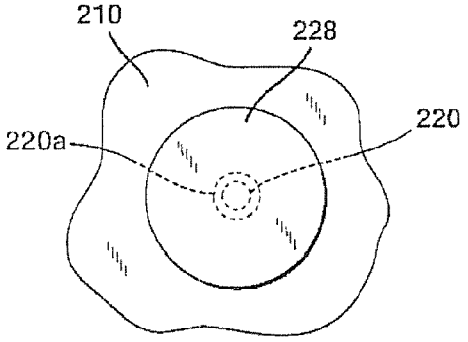

Other possible embodiments are shown in FIGS. 9-15. In FIG. 9, a first receiver 216 in the form of a post 220 includes an oversized spherical head 220*a* that serves to mechanically capture an adjacent fluid-agitating element 218 (shown in phantom). The post 220 is integrally formed with the vessel, which is preferably a bag 210 but may be partially or completely rigid. On the outer surface of the vessel 210, a low-profile second receiver 226 in the form of a of an outwardly-directed projection 228 is provided for receiving a corresponding portion 224*a* of the adjacent motive device 224. The projection 228 may have any shape desired, including square, circular, or the like (see FIGS. 9*a* and 9*b*), with the portion 224*a* having a corresponding shape. Once the projection 228 aligns with and receives the corresponding portion 224*a*, the captive fluid-agitating element 218 is properly aligned with the adjacent motive device 224.

Figure 10:
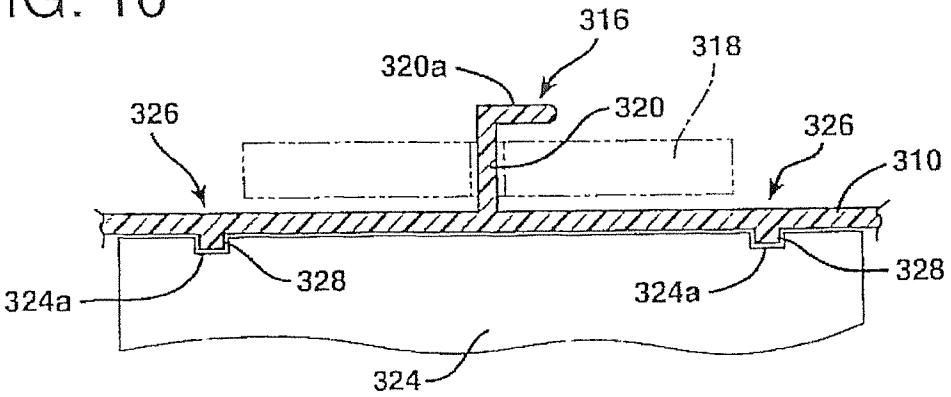
FIG. 10 is an enlarged, partially cross-sectional, partially cutaway side view of still another embodiment of the vessel of the present invention.
Figure 10B:
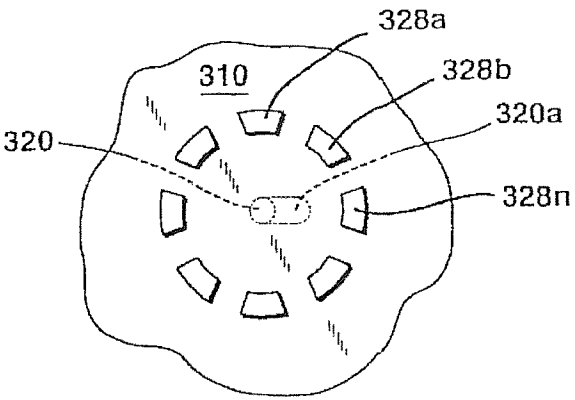
FIGS. 10*a* and 10*b* are cutaway bottom views of the vessel of FIG. 10 showing two different embodiments.
Figure 10A:
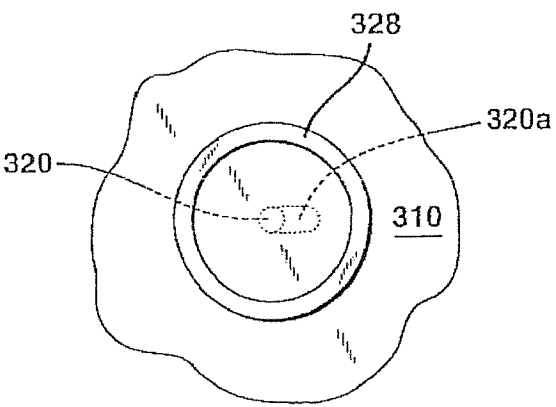

Another embodiment is shown in FIG. 10 in which the vessel 310 may be rigid or at least partially flexible. In this embodiment, the first receiver 316 is a post 320, which is shown merely for purposes of illustration as having an L-shaped head portion 320*a* for mechanically capturing an adjacent fluid-agitating element 318 (shown in phantom). The second receiver 326 is in the form of at least one projection 328 substantially concentric with the post 320. The projection 328 may be square, circular, or may have any other desired shape. The projection may also be continuous, as shown in FIG. 10*a*, or interrupted to form segments 328*a*, 328*b* . . . 328*n*, as shown in FIG. 10*b*. Although a plurality of segments are shown, it should be appreciated that the number of segments provided may be as few as one, regardless of the shape of the projection 328 (and could even be a single stub offset from the post 320). The corresponding portion 324*a* of the motive device 324 that is received by the second receiver 326 is similarly shaped and preferably continuous, but could also have one or more segments matching the segments in the vessel 310 (including a single offset bore).

Figure 11:
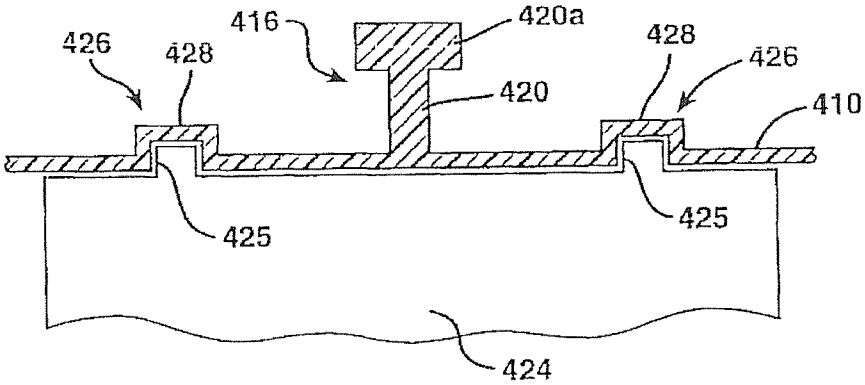
FIG. 11 is an enlarged, partially cross-sectional, partially cutaway side view of another embodiment of the vessel of the present invention.
Figure 11B:
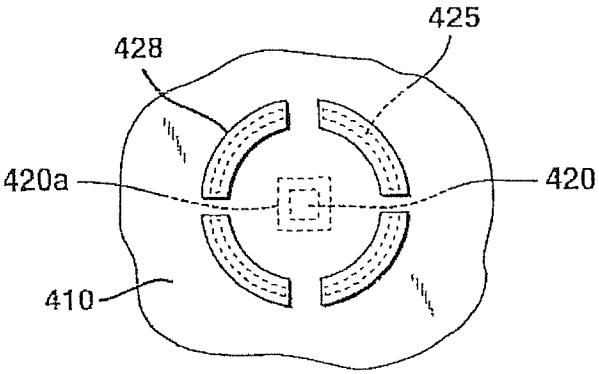
FIGS. 11*a* and 11*b* are cutaway bottom views of the vessel of FIG. 11 showing two different embodiments.
Figure 11A:
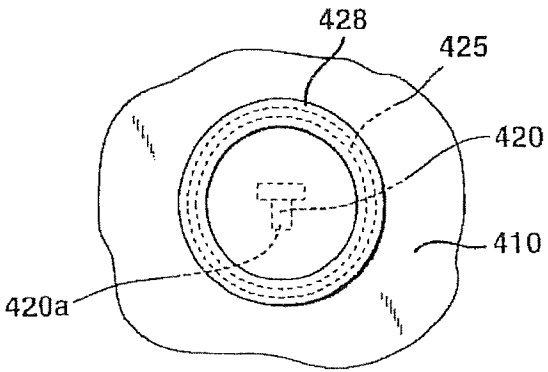

In the embodiment of FIG. 11, the vessel 410 includes a first receiver 416 in the form of a post 420, again shown with an oversized T-shaped head 420*a*. The second receiver 426 includes at least one channel, recess, or groove 428 formed in the vessel 410. A corresponding projection 425 is provided in the motive device 424 for engaging the channel, recess or groove 428 to provide the desired alignment function, such as between driving magnets and driven magnets, between driven magnets and a rotating superconducting element, or between any other driver and a driven structure associated with a fluid-agitating element. The channel, groove, or recess 428 is preferably continuous (see FIG. 11*a*, with the projection 425 shown in phantom), but may be segmented as well (see FIG. 11*b*).

Figure 12:
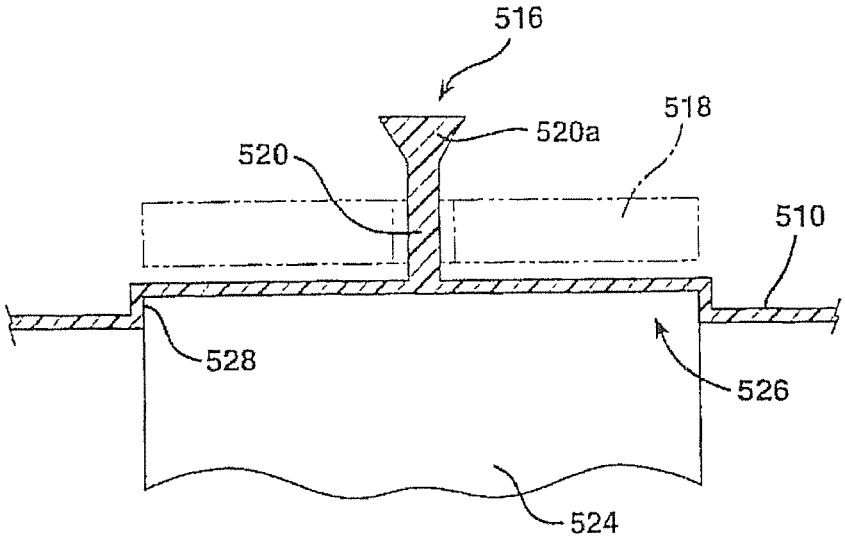
FIG. 12 is an enlarged, partially cross-sectional, partially cutaway side view of still another embodiment of the vessel of the present invention.

Yet another embodiment is shown in FIG. 12. In this embodiment, the vessel 510 again includes a first receiver 516 in the form of a post 520, which is shown for purposes of illustration as having a frusto-conical head to create a Y-shaped cross-section. The second receiver 526 is in the form of a low-profile recessed portion 528 formed in the vessel 510. This recessed portion 528 is sized and shaped for receiving a portion of the motive device 510, and thus ensures that the proper alignment is achieved between a fluid-agitating element 518 concentric with the post 520 and any structure for levitating and/or rotating the element. As with the embodiments described above, the recessed portion 528 may have any shape desired, including square, circular, triangular, rectangular, polygonal, or the like.

Figure 13:
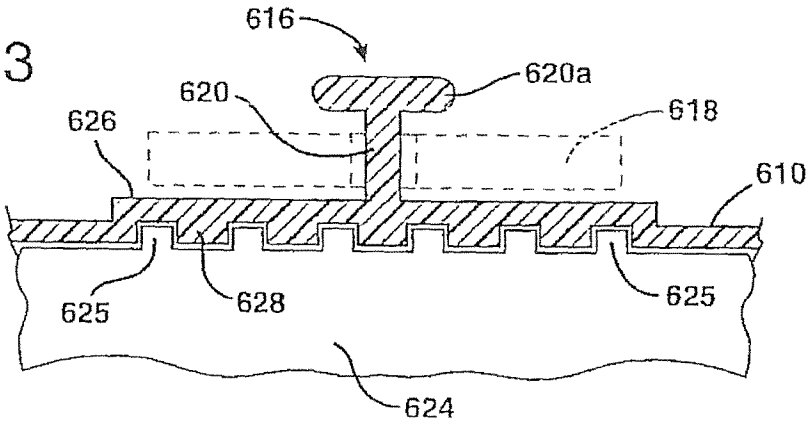
FIG. 13 is an enlarged, partially cross-sectional, partially cutaway side view of still another embodiment of the vessel of the present invention.
Figure 13B:
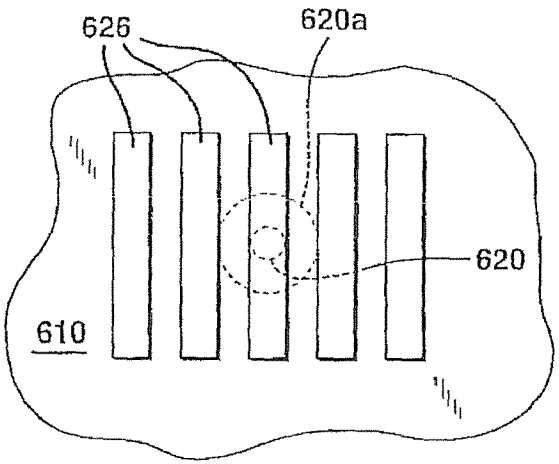
FIGS. 13*a* and 13*b* are cutaway bottom views of the vessel of FIG. 13 showing two different embodiments.
Figure 13A:
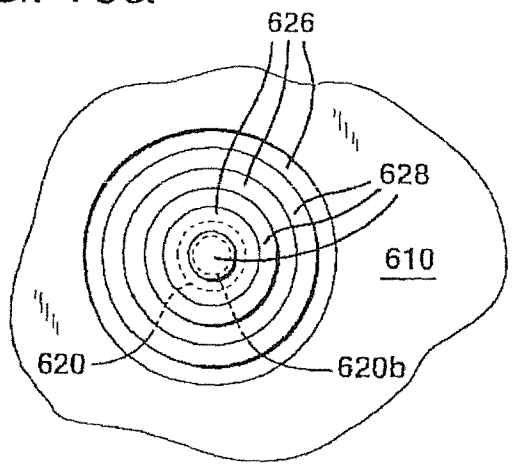

FIG. 13 illustrates an embodiment wherein the vessel 610 is provided with a first receiver 616 in the form of a post 620 having a head 620*a* (shown as disc-shaped), as well as a plurality of structures 628 defining second receivers 626 adapted for receiving a portion of an external structure, such as a projection 625 formed on an end face of a motive device 624. The second receivers 626 may be in the form of concentric ring-shaped recesses 628, as illustrated in FIG. 13*a*, but could also comprise concentric squares or even arrays of straight lines, as shown in FIG. 13*b*. Three second receivers 626 are shown in FIGS. 13 and 13*a*, but it should be appreciated that more or fewer may be provided as desired. Indeed, the number of structures provided may be used as an indicator of the size, shape, or other characteristic of the fluid-agitating element 618 in the vessel 610, which thus allows the user to select a suitable motive device (such as one having a superconducting element having a particular characteristic).

Figure 14:
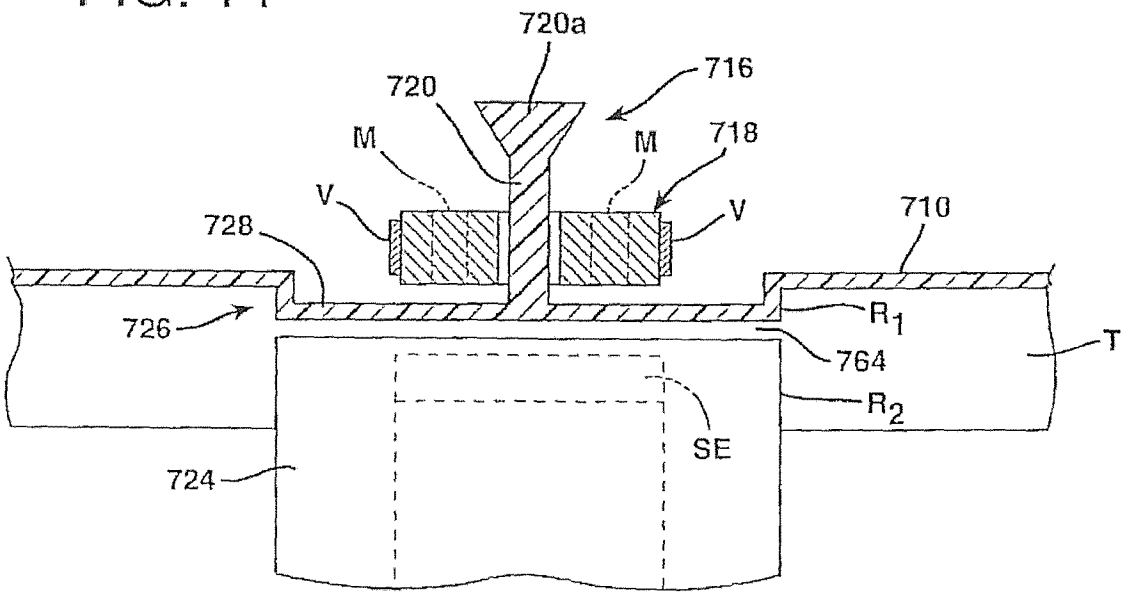
FIG. 14 is an enlarged, partially cross-sectional, partially cutaway side view of yet another embodiment of the vessel of the present invention.

FIG. 14 shows an embodiment wherein the vessel 710, which again may be rigid or partially flexible, includes a first receiver 716 in the form of a post 720 having an oversized head portion 720*a* and a second receiver 726 in the form of a hat or cup-shaped projection 728 (which may be integrally formed or a separate rigid portion). The second receiver 726 receives a portion of an intermediate support structure T including a first recess $R_1$ on one side and a second recess $R_2$ on the opposite side. The second recess $R_2$ is adapted for receiving at least a portion of the motive device 724, which is shown as a cryostat including a rotating, thermally isolated superconducting element SE for coupling with at least two alternating polarity magnets M (or alternatively, the head of the cryostat may be attached to a bearing positioned in recess $R_2$ and rotated). This particular embodiment dispenses with the need for forming a locator bore in the motive device 724 to align the fluid-agitating element 718 therewith (although it remains possible to provide such a bore for receiving a projection on the support structure T to achieve the alignment function). Generally, it is of course desirable to form the wall 764 between the recesses $R_1$, $R_2$ as thin as possible to enhance the stiffness of the coupling used to rotate and/or levitate the adjacent fluid-agitating element 718 (which includes vanes V).

Figure 15:
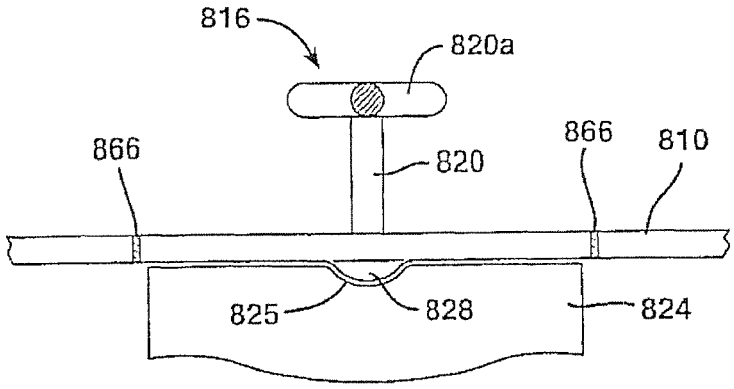
FIG. 15 is an enlarged, partially cross-sectional, partially cutaway side view of a further embodiment of the vessel of the present invention.
Figure 15A:
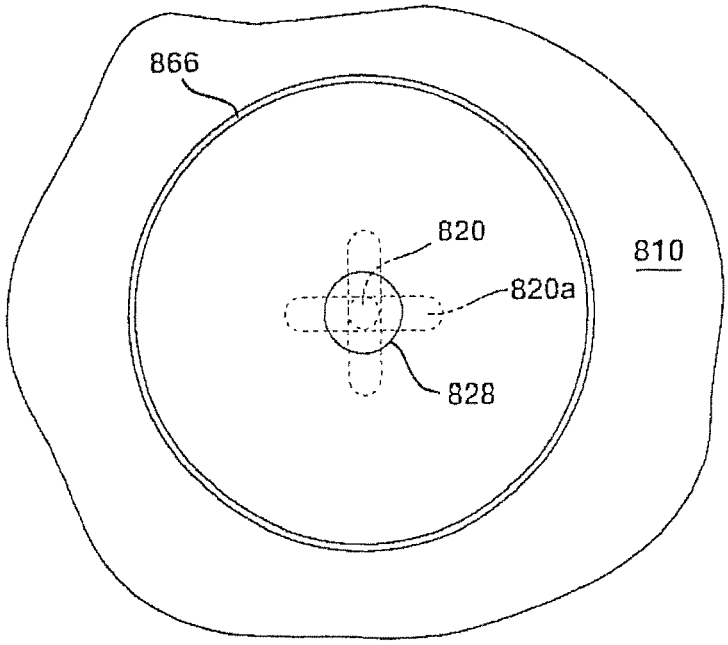
FIG. 15*a* is a bottom view of the vessel of FIG. 15 showing two different embodiments.

FIG. 15 shows an embodiment where a second receiver 826 in the form of a slightly raised projection 828 is provided in the vessel 810 that corresponds to a dimple 825 formed in an external structure, such as the end face of the motive device 824. As should be appreciated, the opposite arrangement could also be used, with the dimple formed in the vessel 810 and serving as a second receiver 826. Optionally, or instead of the projection 828/dimple 825 combination, at least one indicia may be provided to allow an observer to determine the proper location of the structure such as motive device 824 relative to the vessel 810. The indicia is shown as a darkened ring 866 formed in the outer wall of the vessel 810, which could be a bag or a rigid or semi-rigid container. However, it should be appreciated that the indicia could be in the filial of one or more marks placed on or formed in the outer surface of the vessel 810 (including even possibly a weld or seal line), or even marks placed on the opposite sides of an intermediate support surface (not shown). In any case, the indicia 866 is preferably designed such that it helps to align the motive device 824 relative to a first receiver 816 in the vessel 810 for receiving and defining a home location for a fluid agitating element, such as the post 820 (which is shown having a cross-shaped head 820*a*). The indicia 866 thus helps to ensure that the fluid-agitating element is aligned with any driving or levitating structure held therein.

Figure 17:
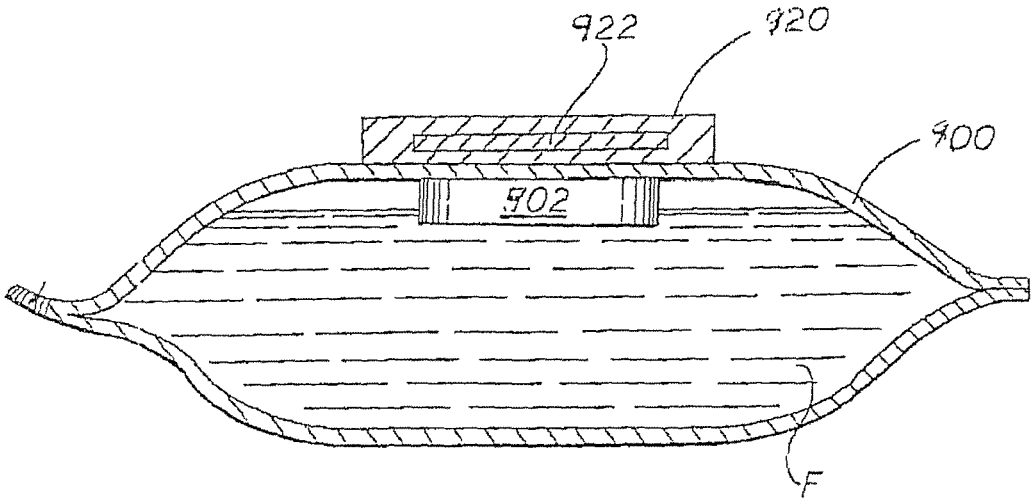
FIG. 17 illustrates an alternative embodiment of a mixing bag with a coupler according to one aspect of the invention.

As shown in FIG. 17, it may be desirable to place an attachment 920, cover, or similar device including a coupler 922 formed of a ferromagnetic material or the like adjacent to the bag 900, especially in cases where it is sealed with the magnetic fluid-agitating element 902 inside during manufacturing. This coupler 922 is thus attracted to and forms a magnetic coupling with the magnetic fluid-agitating element 902 when the attachment 920 is in place. The attachment 920 should be fabricated of a non-magnetic material, such as rubber. The coupler 922 when made of a ferromagnetic material will shield the magnetic field created by the fluid-agitating element 902. When the assembly including the bag 900 and the fluid-agitating element 902 is ready for use, the attachment 920 may simply be removed from the bag 900 to break the magnetic coupling between the fluid-agitating element 902 and the coupler 922, such that the arrangement is ready for agitating any fluid F provided.

Figure 18:
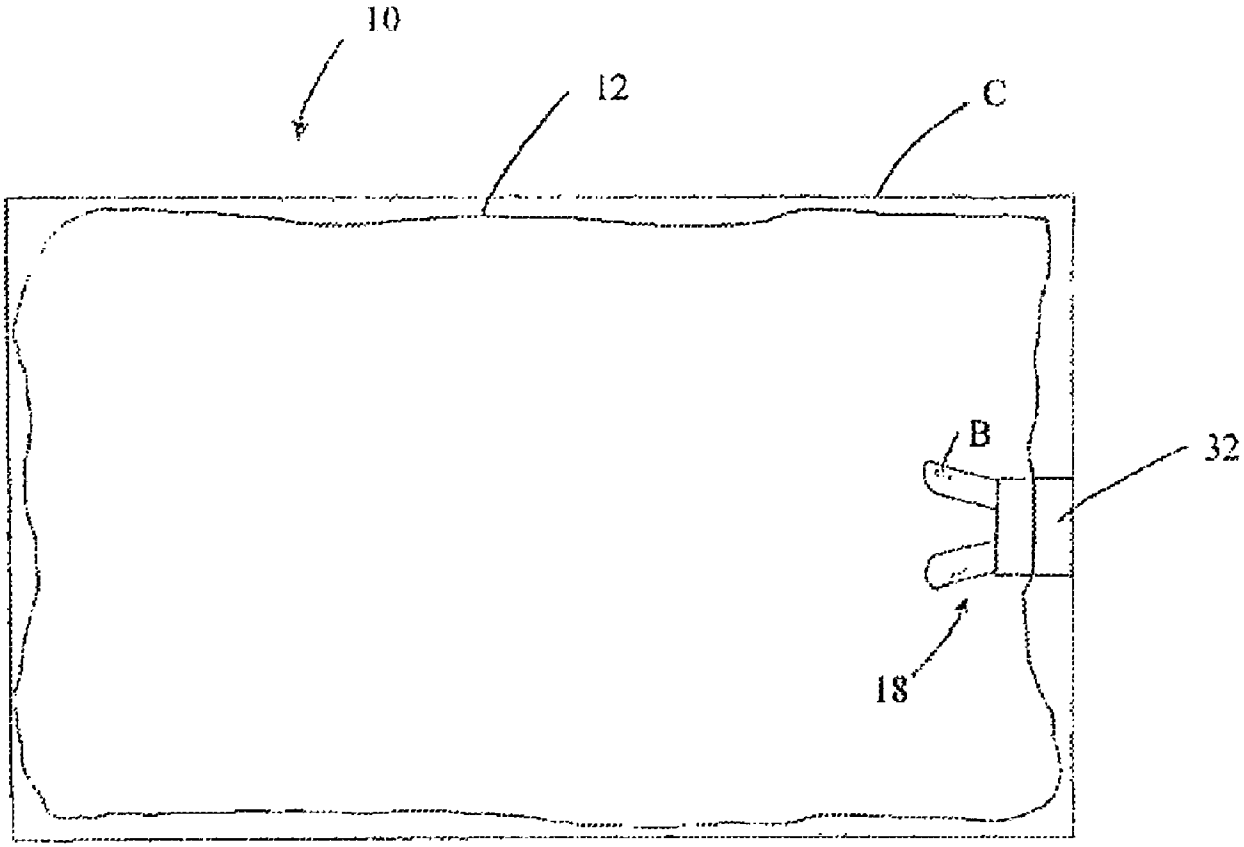
FIG. 18 is a schematic side view illustrating an embodiment of a mixing bag with a coupler according to one aspect of the invention.

FIG. 18 shows an embodiment in which the coupler 32 forming the attachment is associated with the container C for purposes of holding a magnetic fluid-agitating element 18 (which is shown as a magnetic impeller with blades B) in place. Specifically, the coupler 32 holds or retains the element 18 at a home location within a mixing bag 10 having a flexible portion 12 (sidewall) received in the interior compartment of the container C. The bag 10 is shown in FIG. 18 as being oversized and spaced relative to the sidewalls defining the interior compartment of the container C. However, this is for purposes of illustration only.

The container C may be a shipping box or like structure for receiving and delivering the bag 10 and fluid-agitating element 18 to a site for use in mixing a fluid. Preferably, the material forming the container C is more rigid that the relatively thin, flexible material used to form at least a portion of the bag 10. Although the bag 10 is shown without any rigid portion or like structure for receiving the fluid-agitating element 18, it should be appreciated that one may be provided.

The coupler 32 may comprise a magnet (e.g., a permanent magnet or a ferromagnetic material), for forming a magnetic coupling with the magnetic field of the fluid-agitating element. The coupler 32 is preferably affixed to the interior surface of a wall of the container C using an adhesive, strap, magnet, or like structure. Hence, as shown, the arrangement may be such that the coupler 32 is positioned between an external surface of the bag 10 and an interior surface of the container C when the two are nested.

As a result of this arrangement, the fluid-agitating element 18 may be anchored in place by the coupler 32 during shipping of the bag 10 with the container C, which helps to reduce the chance of deleterious perforation that might otherwise result. When the bag 12 is to be used apart from the container C, the coupling with coupler 32 is simply broken, and the magnetic fluid-agitating element 18 associated with a suitable motive device external to the container C, as shown for example in FIG. 2. Mixing of a fluid introduced to the bag 12 may then proceed in the desired fashion.

Obvious modifications or variations are possible in light of the above teachings. For example, instead of forming the rigid portion 14 as part of the bag 10 by forming a seal at an interface between the two, it could also be positioned in contact to an inner or outer surface of the bag and attached using vacuum-forming techniques, adhesives, or the like. For example, in the cap-shaped embodiment of FIG. 3*a*, the bag 10 would essentially line the inside surfaces of the sidewall 34 and end wall 36 (see FIG. 16*a*). Likewise, in the embodiment of FIG. 4*a*, the bag 10 would cover the sidewall 34 and end wall 36 (see FIG. 16*b*). In both cases, the need for the flange 22 may be eliminated. It is also possible to provide any of the first receivers with a tapered or frusto-conical engagement surface that mates with a corresponding surface on the fluid-agitating element, as disclosed in my co-pending patent application Ser. No. PCT/US01/31459.

The foregoing descriptions of various embodiments of the present inventions have been presented for purposes of illustration and description. These descriptions are not intended to be exhaustive or to limit the invention to the precise forms disclosed. The embodiments described provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An apparatus for containing a bag including a mixer adapted to be driven by an external motive device and a projection, comprising:

a container for receiving the bag; and a coupler comprising an aperture for receiving the projection of the bag and for forming a non-contact coupling with the mixer of the bag.

2. The apparatus of claim 1, wherein the container comprises a box.

3. The apparatus of claim 1, wherein the container comprises a rigid box.

4. The apparatus of claim 1, wherein the mixer is at least partially magnetic, and the coupler comprises a magnetic material for forming a coupling with the at least partially magnetic mixer.

5. The apparatus of claim 1, wherein the coupler is affixed to the container.

6. An apparatus for use in fluid processing using a motive device, comprising:

a bag including a mixer adapted to be moved by way of the motive device;

a container for receiving the mixing bag; and a coupler for forming a non-contact coupling with the mixer.

7. The apparatus of claim 6, wherein the container comprises a box.

8. The apparatus of claim 6, wherein the container comprises a rigid box.

9. The apparatus of claim 6, wherein the mixer is at least partially magnetic, and the coupler comprises a magnetic material for forming a coupling with the at least partially magnetic mixer.

10. The apparatus of claim 6, wherein the coupler is affixed to the container.

11. The apparatus of claim 6, wherein the coupler is positioned in a compartment of the container.

12. The apparatus of claim 6, wherein the coupler is positioned along a sidewall of the container corresponding to the location of the mixer.

13. A method of protecting a bag including a mixer adapted for being moved by way of an external motive device, comprising:

providing the bag in a container;

providing a coupler for coupling with the mixer in the bag; and transporting the bag with coupler.

14. The method of claim 13, further including the step of associating the coupler with a compartment of the container.

15. The method of claim 13, further including the step of affixing the coupler to a wall of the container.

16. The method of claim 13, wherein the mixer is at least partially magnetic, and further including the step of forming a magnetic coupling with the coupler prior to transporting the container.

17. The method of claim 16, further including the step of breaking the magnetic coupling with the coupler.

18. The method of claim 16, further including the step of forming a magnetic coupling between the mixer and the motive device.

19. The method of claim 13, further including the step of passing a portion of the bag into the coupler.

20. The method of claim 13, further including the step of passing a portion of the coupler over a portion of the bag.

21. The method of claim 13, further including the step of passing a projection connected to the bag into the coupler.

22. An apparatus for containing a bag including a mixer adapted to be driven by an external motive device and a projection, comprising:

a container for receiving the bag; and a coupler including an interface comprising an aperture for receiving the projection of the bag and for forming a non-contact coupling with the mixer of the bag.

* * * * *